United States Patent [19]

Peck

[11] Patent Number: 4,510,875

[45] Date of Patent: Apr. 16, 1985

[54] SYSTEM FOR PROCESSING WORKPIECES FOR SEWING

[75] Inventor: Alan M. Peck, Beverly, Mass.

[73] Assignee: USM Corporation, Farmington, Conn.

[21] Appl. No.: 528,120

[22] Filed: Aug. 31, 1983

[51] Int. Cl.[3] ..... D05B 21/00

[52] U.S. Cl. ..... 112/121.12; 112/158 E

[58] Field of Search ..... 112/121.11, 121.12, 112/121.15, 121.29, 158 E, 158 F, 158 B, 2, 121.14

[56] References Cited

U.S. PATENT DOCUMENTS 4,092,938 6/1978 Coughenour et al. ..... 112/158 E 4,166,423 9/1979 Brienza et al. ..... 112/158 E X 4,216,732 8/1980 Marsh et al. ..... 112/158 B 4,329,933 5/1982 Beckerman et al. ..... 112/121.11 X 4,331,089 5/1982 Widmer ..... 112/121.11

4,370,938 2/1983 Bergvall ..... 112/158 E

*Primary Examiner*—H. Hampton Hunter

*Attorney, Agent, or Firm*—William F. White

[57] ABSTRACT

A system is disclosed for automatically processing workpieces requiring more than one stitch pattern. The system is operative to automatically select one of a number of previously assigned stitch patterns when a workpiece is presented for sewing. The automatic selection is accompanied by an incremental pointing to the next stitch pattern which is to be sewn when the workpiece is again presented for sewing.

10 Claims, 21 Drawing Figures

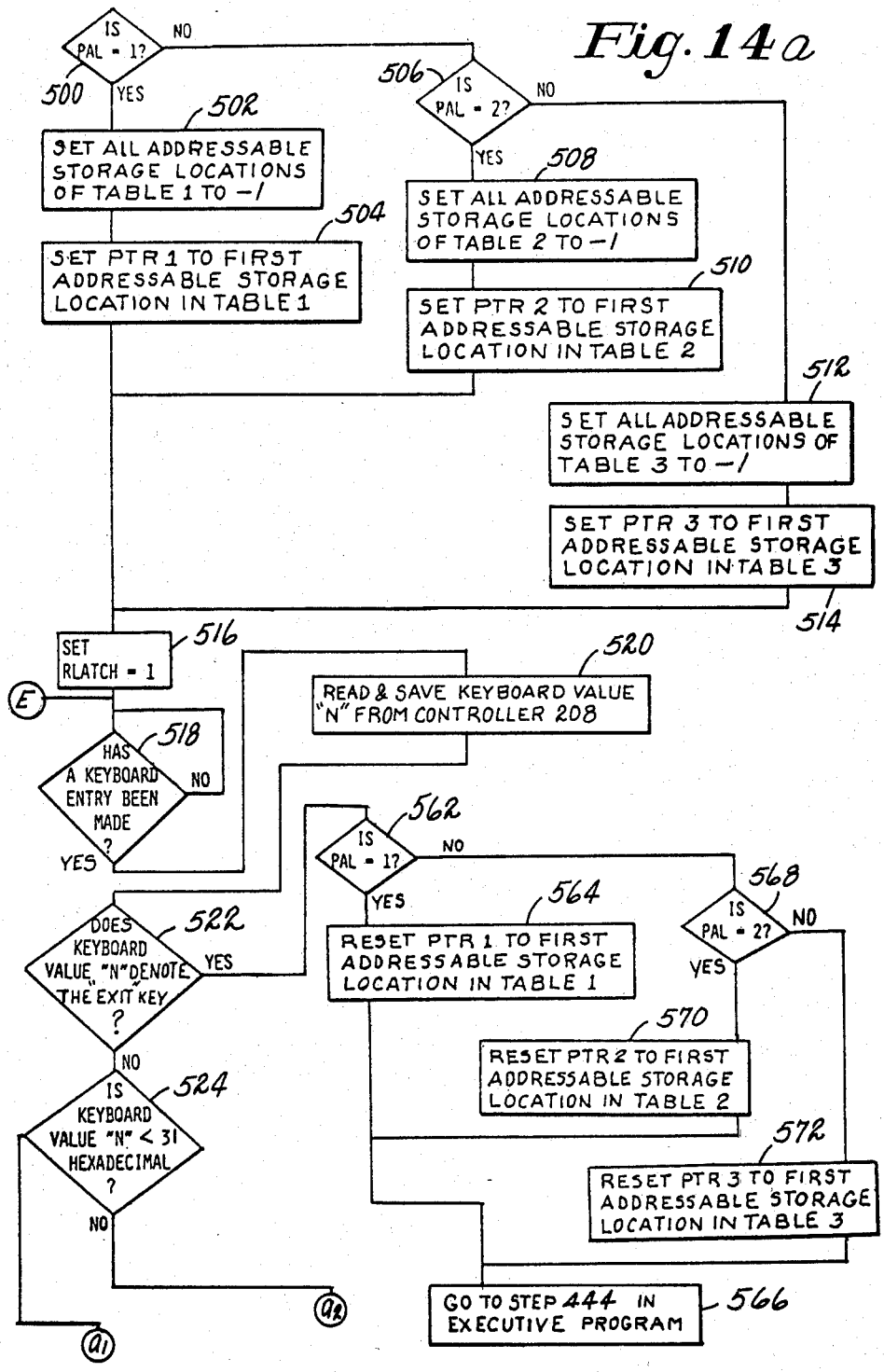
Fig. 14a
IS PAL = 1?
NO
YES
500
SET ALL ADDRESSABLE STORAGE LOCATIONS OF TABLE 1 TO -1
502
SET PTR 1 TO FIRST ADDRESSABLE STORAGE LOCATION IN TABLE 1
504
506
IS PAL = 2?
NO
YES
508
SET ALL ADDRESSABLE STORAGE LOCATIONS OF TABLE 2 TO -1
510
SET PTR 2 TO FIRST ADDRESSABLE STORAGE LOCATION IN TABLE 2
512
SET ALL ADDRESSABLE STORAGE LOCATIONS OF TABLE 3 TO -1
SET PTR 3 TO FIRST ADDRESSABLE STORAGE LOCATION IN TABLE 3
514
SET RLATCH = 1
516
E
READ & SAVE KEYBOARD VALUE "N" FROM CONTROLLER 208
520
HAS A KEYBOARD ENTRY BEEN MADE ?
518
NO
YES
DOES KEYBOARD VALUE "N" DENOTE THE EXIT KEY ?
522
YES
NO
IS KEYBOARD VALUE "N" < 31 HEXADECIMAL ?
524
NO
a1
a2
IS PAL = 1?
562
NO
YES
RESET PTR 1 TO FIRST ADDRESSABLE STORAGE LOCATION IN TABLE 1
564
IS PAL = 2?
568
NO
YES
RESET PTR 2 TO FIRST ADDRESSABLE STORAGE LOCATION IN TABLE 2
570
RESET PTR 3 TO FIRST ADDRESSABLE STORAGE LOCATION IN TABLE 3
572
GO TO STEP 444 IN EXECUTIVE PROGRAM
566

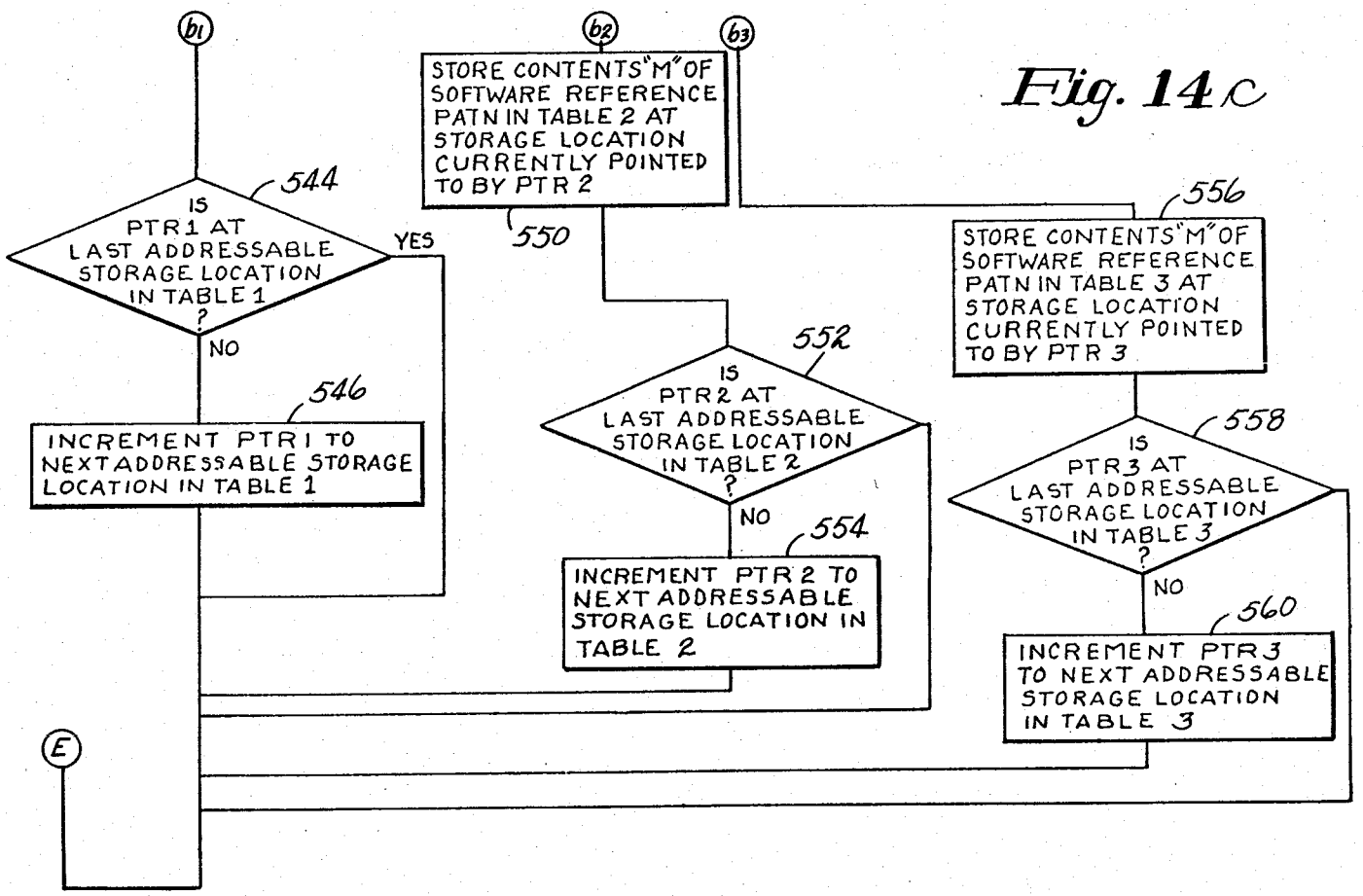
Fig. 14C
b1
b2
b3
E
STORE CONTENTS "M" OF SOFTWARE REFERENCE PATN IN TABLE 2 AT STORAGE LOCATION CURRENTLY POINTED TO BY PTR 2
550
IS PTR1 AT LAST ADDRESSABLE STORAGE LOCATION IN TABLE 1 ?
544
YES
NO
INCREMENT PTR1 TO NEXTADDRESSABLE STORAGE LOCATION IN TABLE 1
546
STORE CONTENTS "M" OF SOFTWARE REFERENCE PATN IN TABLE 3 AT STORAGE LOCATION CURRENTLY POINTED TO BY PTR 3
556
IS PTR2 AT LAST ADDRESSABLE STORAGE LOCATION IN TABLE 2 ?
552
NO
INCREMENT PTR 2 TO NEXT ADDRESSABLE STORAGE LOCATION IN TABLE 2
554
IS PTR3 AT LAST ADDRESSABLE STORAGE LOCATION IN TABLE 3 ?
558
NO
INCREMENT PTR 3 TO NEXT ADDRESSABLE STORAGE LOCATION IN TABLE 3
560

SYSTEM FOR PROCESSING WORKPIECES FOR SEWING

FIELD OF THE INVENTION

This invention relates to the processing of workpieces that are to be sewn by an automatic sewing machine. In particular, this invention relates to the automatic selection of stitch patterns that are to be sewn on the workpieces.

BACKGROUND OF THE INVENTION

U.S. application Ser. No. 266,298, filed on May 22, 1981 and entitled, "Sewing Machine System Having Automatic Identification and Processing of Mounted Work" discloses an automatic sewing machine system wherein workpieces prearranged within pallets are automatically sewn. The system allows each workpiece prearranged within a particular pallet to be automatically identified. This is accomplished by sensing a code present on the pallet. This automatic identification is used to assign a stitch pattern to the workpiece that is to be automatically sewn each time the particular pallet is presented to the automatic sewing machine system. The stitch pattern assignment is made by a separate interactive communication between the operator and the machine following the automatic identification of the pallet containing the workpiece. The stitch pattern thus assigned is automatically sewn each time the particular pallet is presented to the sewing machine system.

The above system furthermore allows for the automatic processing of a number of pallets so as to thereby allow a number of different individual workpieces to each have a particular stitch pattern automatically sewn thereon. This automatic processing of a number of different workpieces continues until either a workpiece is not timely presented, or a workpiece is presented that does not have a stitch pattern previously assigned thereto.

The above described system does not allow for either the assigning or subsequent sewing of a multiple number of stitch patterns on the same or similar workpiece prearranged within the same pallet. In this regard, the same stitch pattern will always be sewn on the workpiece prearranged within the given pallet each time the workpiece is presented for sewing.

OBJECTS OF THE INVENTION

It is an object of the invention to provide a process or system within an automatic sewing machine which allows more than one stitch pattern to be sewn to a workpiece prearranged within a pallet that is presented to the automatic sewing machine;

It is another object of the invention to provide a process or system within an automatic sewing machine which allows a succession of stitch patterns to be sequentially sewn each time a workpiece prearranged within a pallet is presented to the automatic sewing machines; and It is still another object of the invention to provide a process or system within an automatic sewing machine which allows a different stitch pattern to be automatically sewn on a workpiece when the workpiece is next presented to the automatic sewing machine.

SUMMARY OF THE INVENTION

The above and other objects of the invention are achieved by an automatic sewing machine having the capability of automatically sewing one or more previously assigned stitch patterns on a workpiece prearranged within a pallet. The pallet is presented to the automatic sewing machine in such a manner that a code present on the pallet is automatically sensed by a sensor. The thus sensed code is normally associated with one of a number of stitch patterns previously assigned to the sensed code. In this regard, a computer system associated with a sensor is operative to select one of a number of previously assigned stitch patterns in response to the sensor sensing the particular code on the presented pallet. The selection process is accompanied by an incremental pointing to the next stitch pattern in a stored sequence of stitch patterns that have been previously assigned to the sensed code. This stitch pattern will be selected by the computer system when the pallet is again presented to the sensor for the sewing of the workpiece arranged therein.

In accordance with the invention, a number of differently coded pallets may be presented to the automatic sewing machine. Each coded pallet has a respective sequence of previously assigned stitch patterns which are automatically selected in sequential fashion each time the pallet is presented for sewing. Presentation can be made by an automatic processing system which processes each coded pallet through a number of separate locations relative to the automatic sewing machine.

BRIEF DESCRIPTION OF THE DRAWINGS

The above and other features of the invention will now be particularly described with reference to the accompanying drawings, in which:

FIGS. 14*a* through 14*c* illustrate the program logic within the computer of FIG. 9 that facilitates the interactive identification of stitch pattern files with respect to pallets entered by the attendant.

DESCRIPTION OF THE PREFERRED EMBODIMENT

Figure 1:
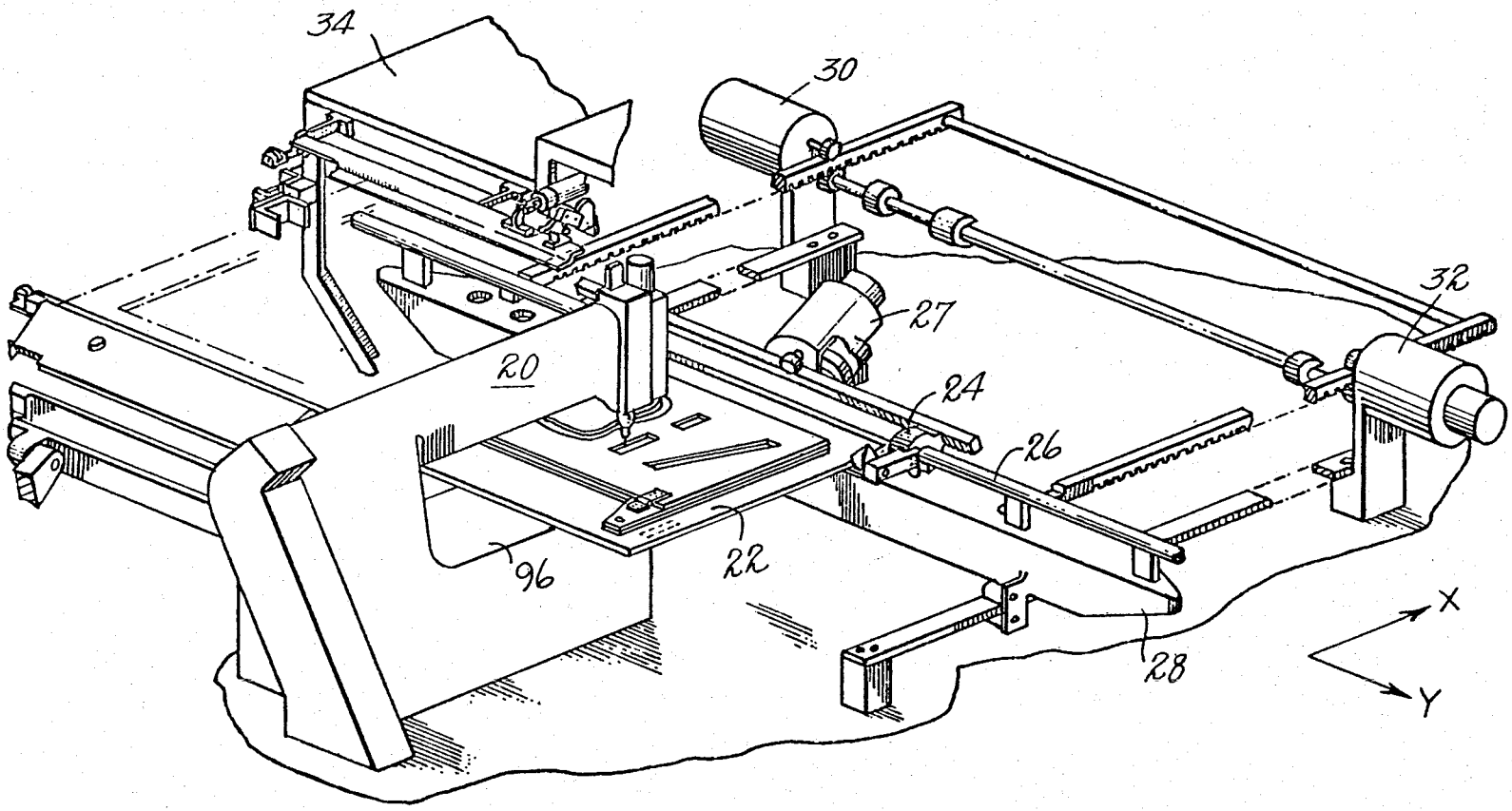
FIG. 1 is an overall perspective view of an automatic sewing machine system having an automatic pallet handling apparatus in association with an automatic positioning system.

Referring to FIG. 1, an automatic sewing machine system having X, Y positioning with respect to a sewing machine head 20 is generally shown.

A pallet 22 is illustrated as being in registered relationship with respect to the sewing machine head 20. The pallet may be of the "join and sew" type wherein several pieces of work are to be prearranged within the pallet. An example of such a pallet is disclosed in U.S. Pat. No. 3,988,993, entitled, "Pallet For Registering and Securing a Workpiece". It is to be appreciated that the workpiece within such a pallet may for instance comprise a number of different pieces which must be joined and sewed together before further pieces can be thereafter added. In this regard, a first stitch pattern may be required to perform the first join and sew operation. This would be followed by adding still further pieces to the sewn workpiece and again presenting the prearranged pieces of work for a second join and sew operation. This second join and sew operation would require a second stitch pattern unique to the workpiece that is then being presented.

It is also to be appreciated that a series of different stitch patterns requiring, for instance, different colored thread might need to be sewn. In this instance, it might be advisable to completely sew a number of workpieces requiring the same color thread before changing the thread color and again presenting the workpieces for sewing a second stitch pattern.

The pallet 22 is mounted to a carriage 24 which is driven in a Y direction along a cylindrical axis 26 by a motor 27. The cylindrical axis 26 is mounted on a frame 28 which is moved in an X direction by a pair of motors 30 and 32. It is to be appreciated that the aforementioned X-Y positioning apparatus has been disclosed as only the preferred embodiment of a positioning system for use in the present invention.

The pallet 22 is moved into position relative to the carriage 24 by a pallet handling system 34. As will be explained in detail hereinafter, the pallet handling system 34 is operative to simultaneously handle at least three pallets. These pallets will occupy respectively an input position, a middle position, and an output position. The pallet 22 is illustrated in FIG. 1 as being in the middle position which allows for automatic sewing.

Figure 2:
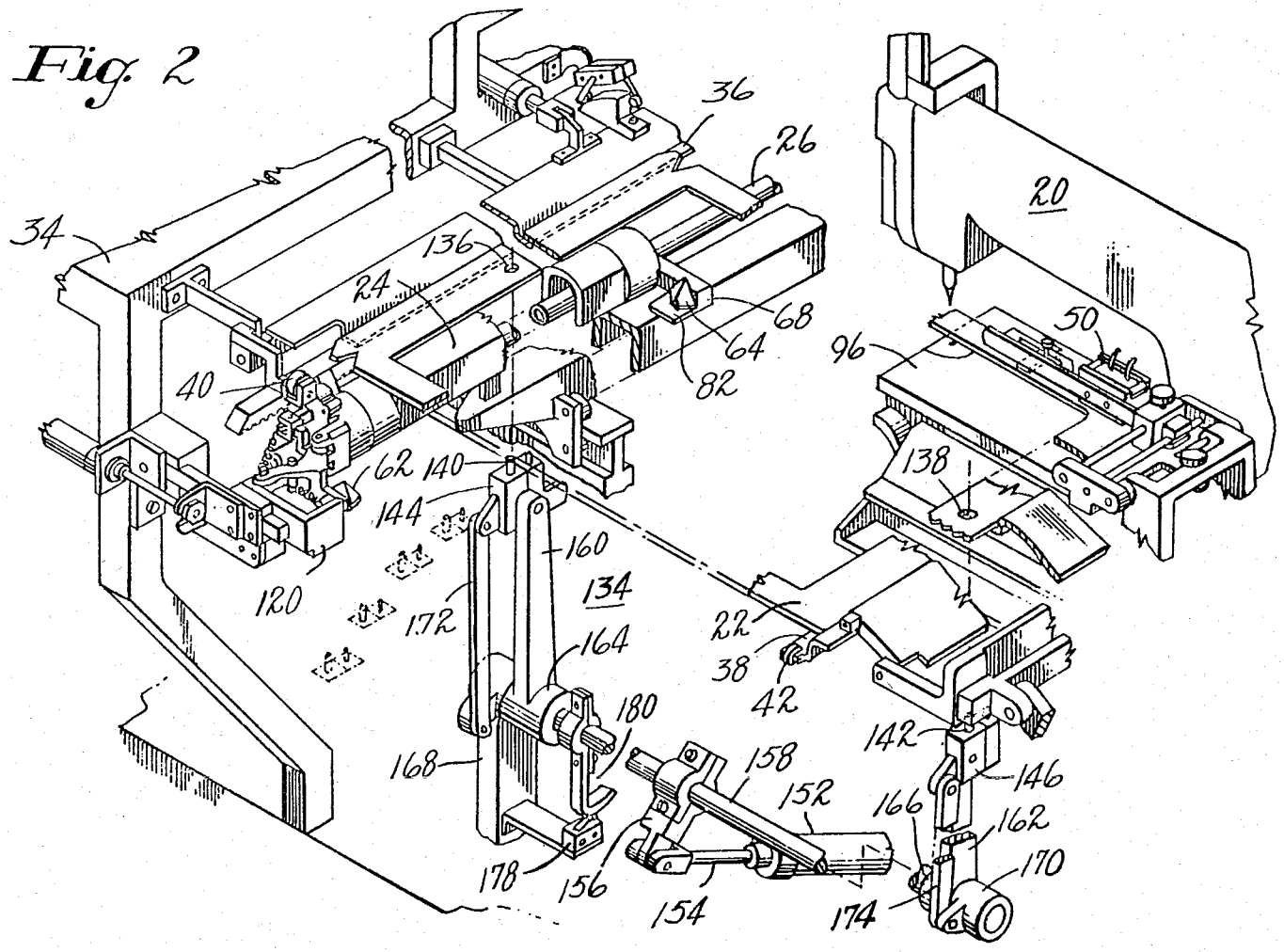
FIG. 2 is a perspective view of the pallet handling apparatus in association with the sewing machine head of the automatic sewing system.

Referring now to FIG. 2, the pallet 22 is illustrated in the input position within the pallet handling system 34. In particular, the pallet 22 is seen to rest on a left shelf 36 and a right shelf 38 of the pallet handling system 34. The pallet has been previously loaded onto the left and right shelves via a pair of rollers 40 and 42.

Figure 3:
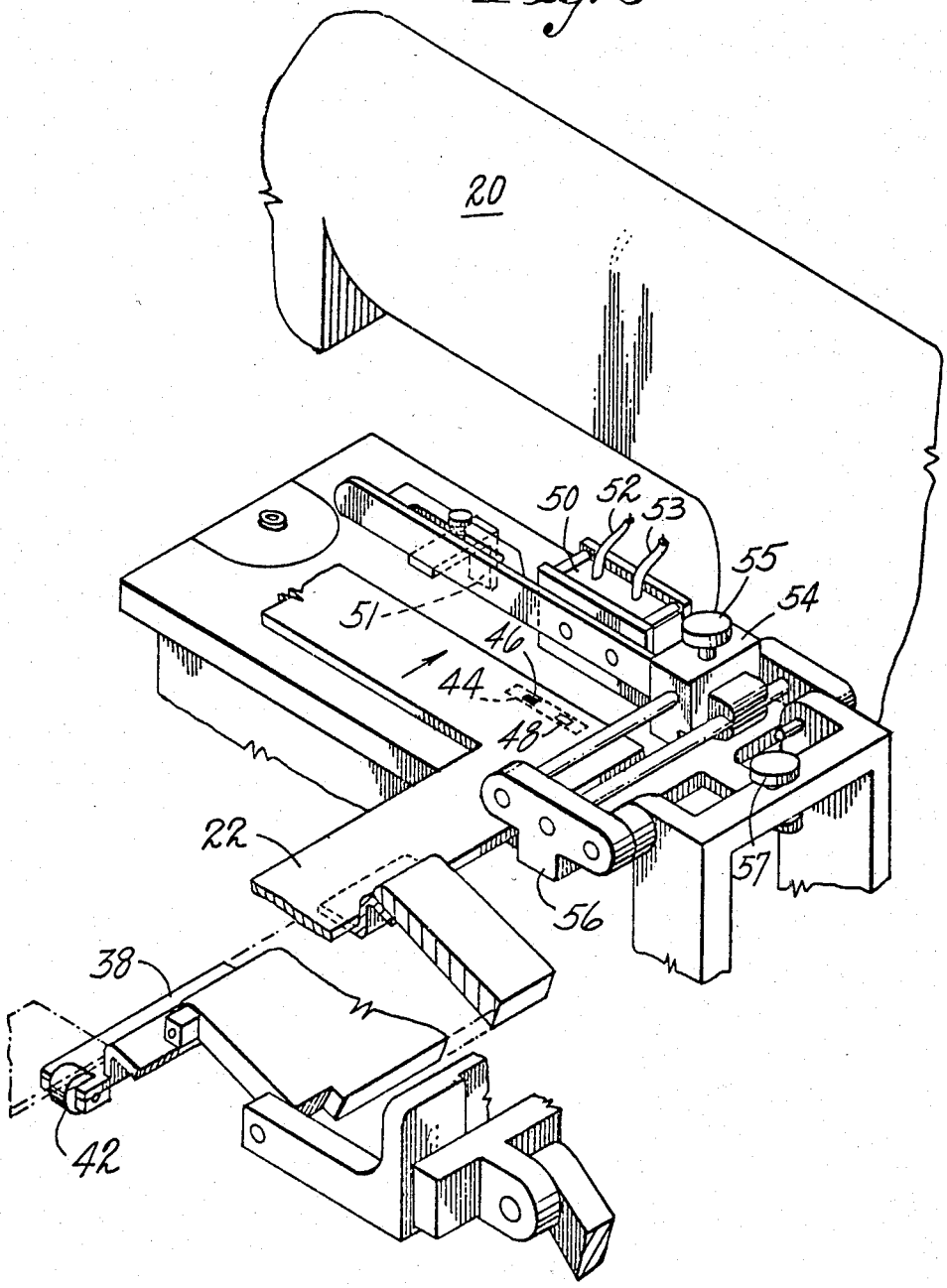
FIG. 3 illustrates the pallet sensor associated with the automatic pallet handling apparatus.

Referring to FIG. 3, a corner of the pallet 22 is shown in the process of being loaded onto the right shelf 38. It is to be noted that the pallet 22 is still being rolled into place over the roller 42. The corner of the pallet 22 is seen to have a pallet identification code 44 impressed thereon. The pallet identification code 44 consists of two separately coded surface areas 46 and 48. The coded surface area 46 is opaque and non-reflective whereas the coded surface area 48 is reflective. It is to be appreciated that various combinations of reflective and non-reflective coded surfaces may occur within the pallet identification code 44. In this regard, the following combinations of coded surfaces may be present in accordance with the present invention.

| Coded Surface 46 | Coded Surface 48 |
|---|---|
| Opaque | Reflective |
| Reflective | Opaque |
| Reflective | Reflective |

The pallet identification code 44 is presented to a pallet identification sensor device 50 when the pallet 22 is moved back against a limit stop 51. When this occurs, the pallet identification sensor device 50 optically senses the coded surfaces 46 and 48. This is done by a pair of separate optical sensors within the pallet identification sensor device 50. Each optical sensor measures the reflection of light from the coded surface presented thereunder. In accordance with the preferred embodiment of the invention, the optical sensor reading the opaque encoded surface of FIG. 3 will produce a logically low signal condition on a line 52. On the other hand, the optical sensor device which senses the reflective coded surface 48 will produce a logically high signal on a line 53. The coded significance of the logic level signals produced as a result of reading the pallet identification code 44 will be further discussed hereinafter. For the present, it is merely to be noted that the condition where both optical sensors do not sense a reflection is reserved for a condition where no pallet is present under the pallet identification sensor device 50.

Figure 9:
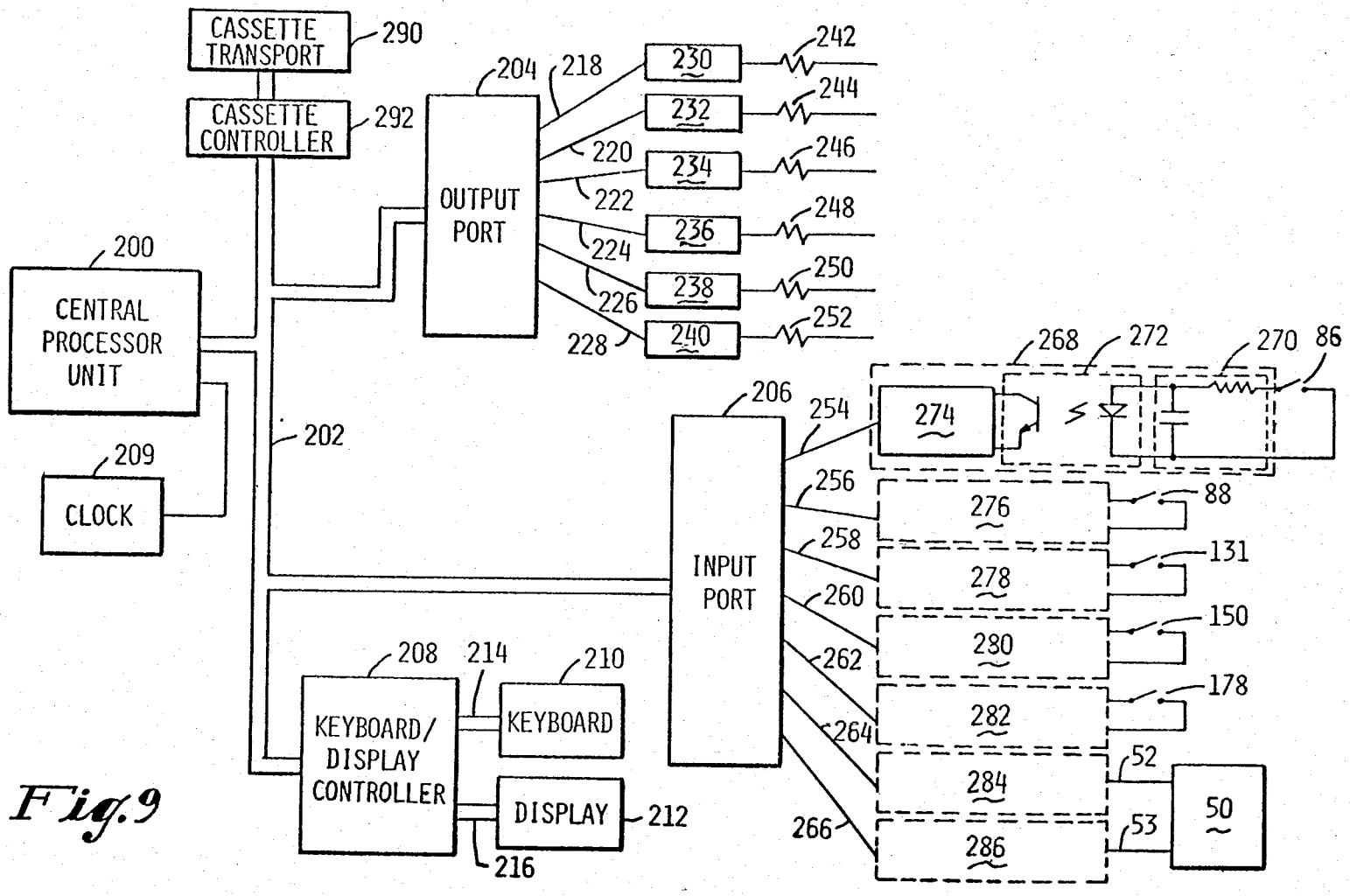
FIG. 9 illustrates the automatic control system associated with the pallet handling apparatus of FIGS. 2–9.

The lines 52 and 53 are connected to an automatic control system which is illustrated in FIG. 9. The details of this control system will be discussed hereinafter in conjunction with FIG. 9. For the present, it is merely to be noted that the control system senses the presence of the pallet in response to the signal conditions on the lines 52 and 53. The control system thereafter sequentially operates the elements comprising the pallet handling system 34 so as to move the sensed pallet through various defined pallet positions. This sequential operation of the elements is premised on the conditions of various switches present within the pallet handling system. These switches interface with the automatic control in much the same manner as the sensor 50. The mechanical operation of the pallet handling system will now be discussed before turning to the detailed description of the automatic control in FIG. 9.

The pallet identification sensor device 50 and the limit stop 51 are adjustably positioned within the pallet handling system 34 by a slidable mount 54 which can be fixed in any position via a set screw 55. In this manner, the position of the pallet identification sensor device 50 can be adjusted so as to accommodate different sized pallets. The mounting structure for the pallet identification sensor device 50 furthermore includes a pivotal mount 56 which allows the pallet identification sensor to be pivoted out of the way during sewing head maintenance.

Figure 4:
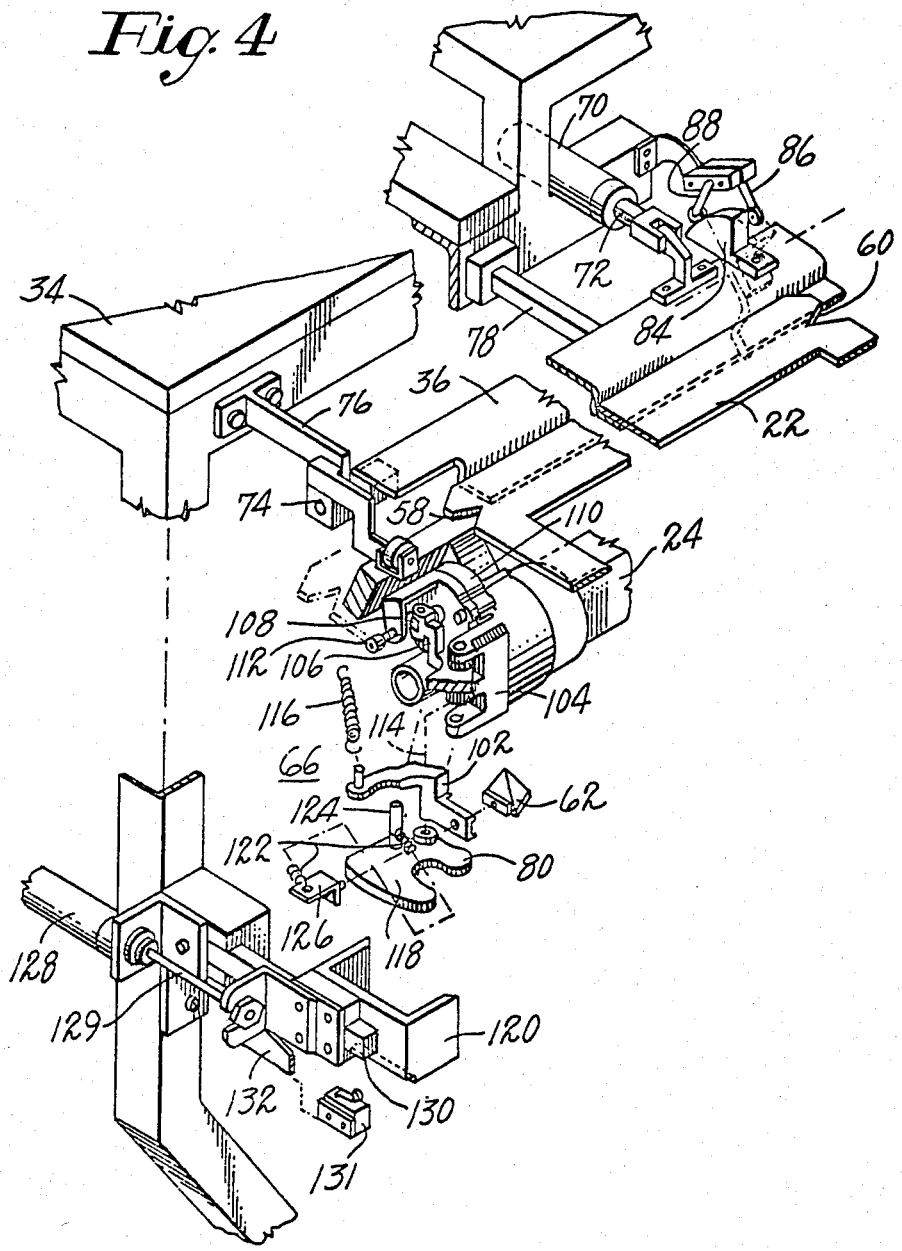
FIG. 4 is a perspective view of a portion of the automatic pallet handling apparatus.
Figure 6:
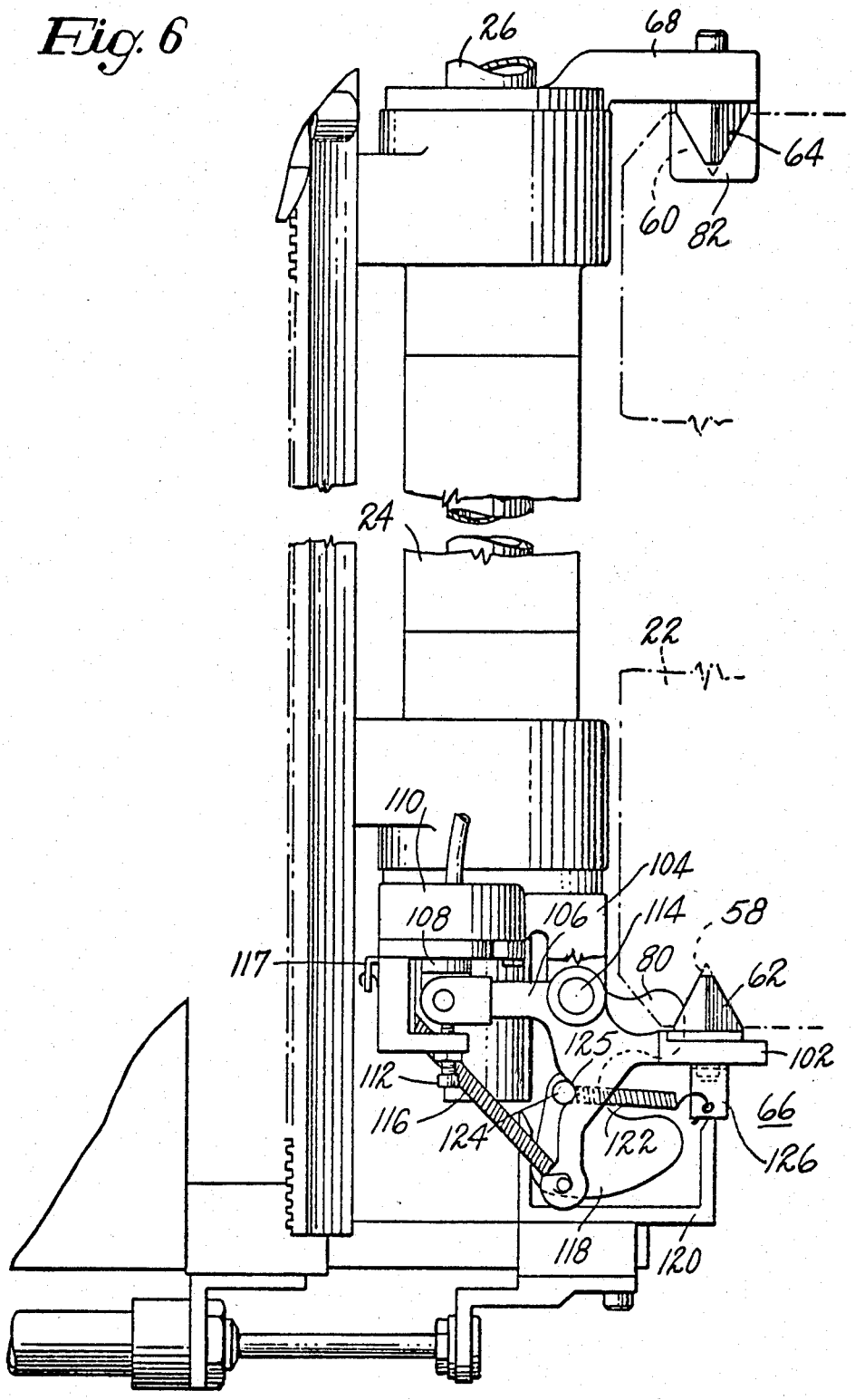
FIG. 6 illustrates the locking of the transferred pallet to a carriage within the automatic positioning system.

Having now described the loading and sensing of the pallet 22 at the top input position, it is now appropriate to turn to the various functioning mechanisms which permit the pallet 22 to assume the middle position within the pallet handling system. Referring to FIG. 4, the left portion of the pallet handling system 34 is illustrated in detail. The left portion of the pallet 22 is illustrated in place on the left shelf 36. This position of the pallet 22 is directly above the carriage 24 to which it is to be ultimately attached. In this regard, the pallet 22 is seen to have two V-notched grooves 58 and 60 located along opposing sides near each corner of the pallet. The V-notches 58 and 60 will ultimately be engaged by a pair of wedges 62 and 64 appearing at either end of the carriage 24 as is shown in FIG. 6. The wedge 62 will be driven into engagement with the V-notch 58 by a pallet clamping mechanism 66 which is attached to the one end of the carriage 24. The wedge 64 is affixed to the other end of the carriage 24 by an arm 68. The wedge 64 acts as a fixed registration for the V-notch 60 during the clamping action of the pallet clamping mechanism 66. The various elements comprising the pallet clamping mechanism 66 will be fully discussed hereinafter.

The manner in which the left edge of the pallet 22 drops downward to the carriage 24 will now be described. As has been previously noted, the left edge of the pallet with the V-notches 58 and 60 to either side rests on the left shelf 36 as shown in FIG. 4. An air cylinder 70 having an output shaft 72 is pivotally attached to the left shelf 36. Upon actuation of the air cylinder 70, the output shaft 72 extends outwardly so as to thereby rotate the left shelf 36 downwardly. The left shelf 36 rotates about a pivotal attachment 74 associated with a frame member 76 and a pivotal attachment (not shown) associated with a frame member 78. When the left shelf 36 has thus been rotated downwardly, the left edge of the pallet 22 drops past it onto a pallet support 80 associated with the wedge 62 and a pallet support 82 associated with the wedge 64. The pallet support 82 is not shown in FIG. 4 but can be seen in FIG. 2. The pallet support 82 is seen to be a tab located underneath the wedge 64. The tab has a sufficient support area projecting outwardly around the perimeter of the wedge 64. This outward tab portion supports a pallet in the vicinity of the V-notch 60 as is illustrated in FIG. 6. The pallet support 80 is also seen to have a tab portion supporting the pallet in the vicinity of the V-notch 58 in FIG. 6. Referring again to the left shelf 36 in FIG. 4, it is seen that a cam member 84 is attached thereto. The cam member 84 is in contact with a limit switch 86 when the left shelf has moved downwardly so as to allow the pallet 22 to drop onto the pallet support members 80 and 82. The cam member is depicted in FIG. 2 as being in contact with a limit switch 88 when the left shelf is in an upward position. As will be explained in detail hereinafter, the automatic control utilizes the switches 86 and 88 during the movement of the left shelf 36.

Figure 5:
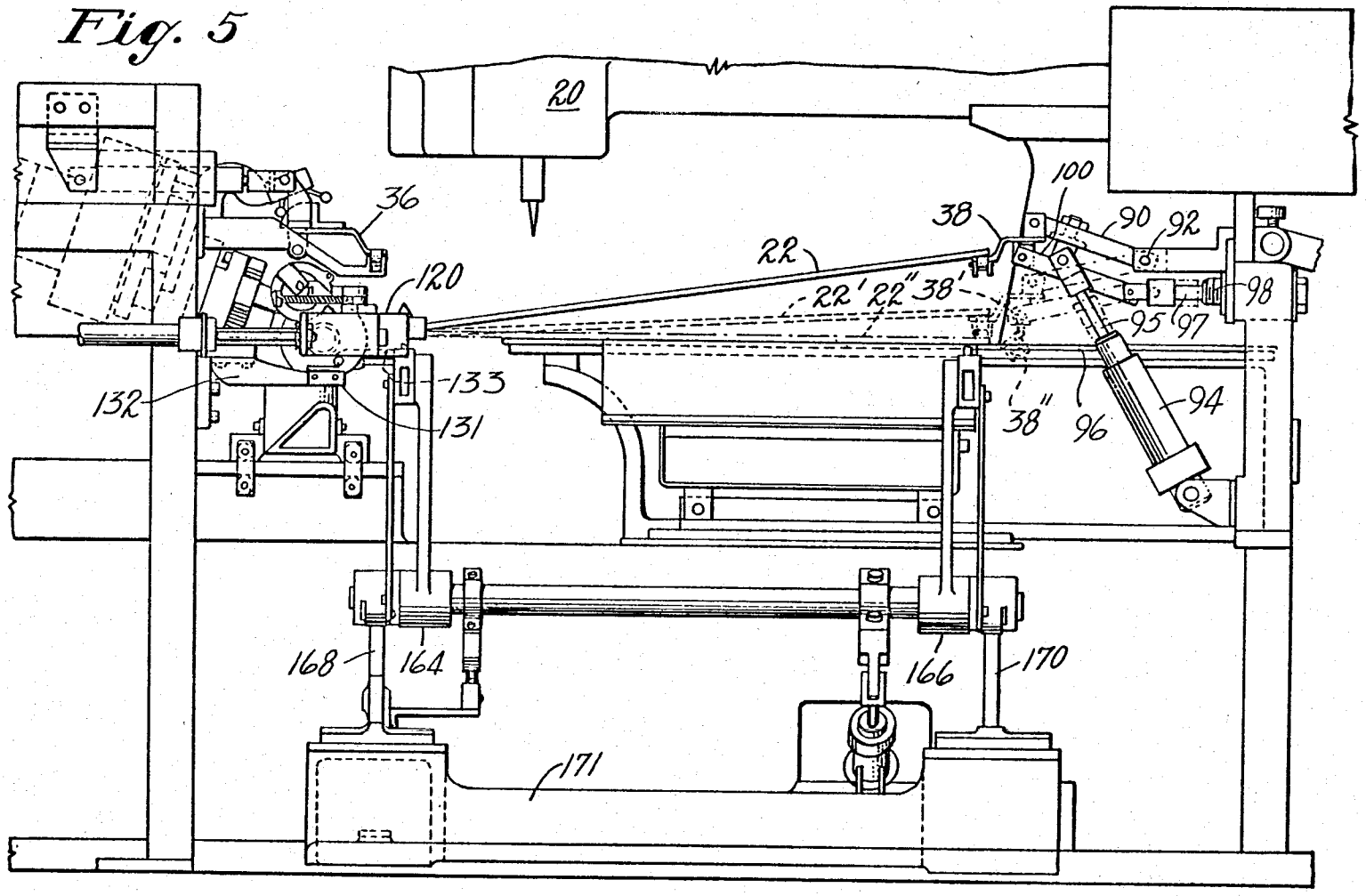
FIG. 5 illustrates the transfer of a pallet within the automatic pallet handling apparatus.

The automatic control is operative to now cause the right side of the pallet 22 to be lowered. Referring to FIG. 5, the right side of the pallet 22 is seen to rest on the right shelf 38 at an elevated position. The right shelf 38 is pivotally connected to an upper bar 90 of a four bar linkage. The upper bar 90 is rotated downwardly about a pivotal point 92 by an air cylinder 94. The retraction of the output shaft 95 of the air cylinder 94 causes the right shelf 38 to assume the position denoted in dotted outline by 38'. The position of the pallet 22 when thus held by the right shelf in the position labelled 38' is illustrated by the dotted outline form labelled 22'. It is to be appreciated that the pallet 22' still rests within the right shelf 38' in this downward position which is only a short distance from the bed 96 of the sewing machine head 20. The pallet 22 is next caused to drop onto the bed 96 by the retraction of an output shaft 97 associated with the air cylinder 98. In this regard, the output shaft 97 associated with the air cylinder 98 is pivotally connected to a lower bar 100 of the double bar linkage. The position of the right shelf 38 following the retraction of the output shaft 97 associated with the air cylinder 98 is illustrated by the dotted outline denoted as 38''. This latter position of the right shelf 38 is such as to completely clear the pallet 22'' which now rests on the reference base 96. The pallet 22'' has now reached the middle position within the pallet handling system. The right shelf 38 can now be rotated upwardly relative to the pivotal point 92 without interfering with the pallet 22''. As will become apparent hereinafter, this latter rotation of the right shelf 38 occurs after the pallet has been clamped by the pallet clamping mechanisms 66 and 68. In any event, the right shelf 38 is reset by first actuating the air cylinder 94 so as to extend the output shaft 95 associated therewith so as to cause the upper bar 90 to rotate about the pivotal point 92. The air cylinder 98 is thereafter actuated so as to extend the output shaft 97 associated therewith so as to thereby cause the lower bar 100 to further position the right shelf upwardly into its reset position.

Once the pallet has assumed the middle position denoted by 22'', it can be clamped by the pallet clamping mechanism 66. Referring to FIG. 4, the elements of the pallet clamping mechanism 66 are illustrated in exploded relationship to one another. The wedge 62 is attached to a pivotal lever 102 which rotates within a fixture 104 forming part of the casting for the carriage 24. Only a portion of the pivotal lever 102 is illustrated within the fixture 104. This portion is seen to include an arm 106 pivotally connected to an output shaft 108 of an air cylinder 110. The output shaft 108 and the air cylinder 110 are clearly shown in FIG. 6. The output shaft 108 is operative to extend outwardly into contact with an adjustable limit stop 112. The outward extension of the shaft 108 causes the pivot lever 102 to rotate about the axis 114 defined by the fixture 104. The rotation of the pivot lever 102 about this axis causes the wedge 62 to move into the notch 58 of the pallet 22 as is shown in FIG. 6. It is to be appreciated that the aforementioned motion of the pivotal lever 102 is against the spring biasing force of a spring 116 connecting the pivotal lever 102 to an eyelet anchor 117 shown in FIG. 6.

It is hence to be appreciated that actuation of the air cylinder 110 causes its output shaft 108 to extend thereby rotating the pivotal lever 102 about the axis 114. This forces the wedge 62 strongly against the notch 58 which in turn urges the notch 60 strongly against the wedge 64. The thus clamped pallet 22 is clearly shown in FIG. 6.

It is to be noted that a heel 118 of the pallet support member 80 is positioned within a cradle 120 in FIG. 6. The cradle 120 is operative to maintain the pallet support member 80 in position below the pallet 22 during the aforementioned clamping or latching operation. The pallet support member 80 is also maintained in place by virtue of a spring 122 attached between a post 124 extending upwardly from the pallet support member 80 and a tab 126 connected to the pivotal lever 102. In this regard, the tensioned spring 122 produces a biasing force on the post 124 which tends to cause the post 124 to engage a rearward curved portion 125 of the pivotal lever 102. This biasing of the post 124 against the curved portion 125 maintains a toe portion of the pallet support member 80 underneath the pallet 22. This position of the pallet support member 80 is maintained during the pattern controlled movement of the pallet 22 with respect to the sewing machine 20. It is to be noted that before the aforementioned movement can take place, it is first of all necessary to move the carriage 24 along the axis 26 so as to remove the pallet support member 80 from within the cradle 120. This is essentially a command of movement in the Y-direction before any movement in the X-direction.

When the pattern stitching has been completed, the X-Y positioning system of FIG. 1 moves the pallet 22 again back to the position illustrated in FIG. 6. At this time, the air cylinder 110 is exhausted. The spring 116 exerts a biasing force on the pivotal lever 102 so as to rotate the pivotal lever about the axis 114. This also causes the shaft 108 to thereby retract within the exhausted air cylinder 110. The result is that the wedge 62 at the end of the pivotal lever 102 disengages from the V-notch 58 within the pallet 22.

Figure 7:
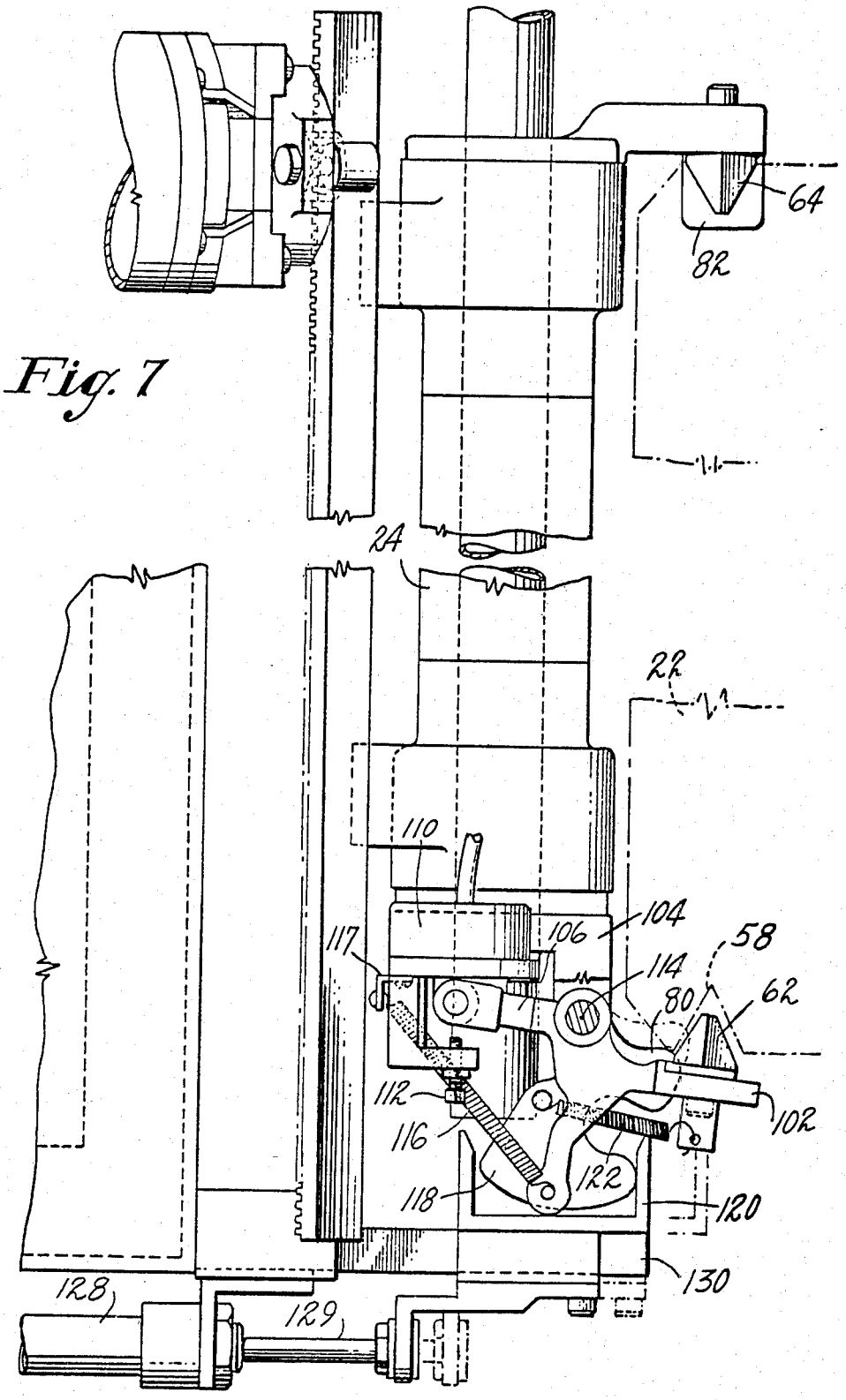
FIG. 7 illustrates the unlocking of the pallet from the carriage of the automatic positioning system.

Referring to FIG. 7, the wedge 62 is illustrated as being withdrawn from the notch 58. FIG. 7 furthermore discloses the actuation of an air cylinder 128 associated with the cradle 120. In this regard, the output shaft 129 of the air cylinder 128 is seen to have moved from a first dotted outline position to a second retracted position. The cradle 120 slides along a guide 130 extending outwardly from the frame of the pallet handling system 34 as is shown in FIG. 4. This movement of the cradle 120 along the guide 130 trips a switch 131. The switch 131 is attached to a downwardly extending member 132 which is connected to the frame of the pallet handling apparatus 34. Referring to FIG. 5, the switch 131 is seen to normally be closed when the output shaft 129 is extended so as to maintain the pallet support 80 in position underneath the pallet. The switch 131 opens when it engages a slot 133 within the slidable attachment to the cradle 120. This later event occurs during retraction of the output shaft 129 which moves the cradle 120 and hence the slot 133 relative to the stationary switch 131 allowing it to open.

The movement of the cradle 120 causes the pallet support member 80 which is registered therein to be rotated backwardly about the axis 114 as is illustrated in FIG. 7. This causes the toe portion of the pallet support member 80 to clear the underside of the pallet 22 as is shown in FIG. 7. The front edge of the pallet 22 now drops downwardly as a result of the removal of the toe portion of the pallet support member 80. The pallet drops down onto a pallet ejector system 134 as shown in FIG. 2. In this regard, a pair of holes 136 and 138 within the pallet 22 are engaged by a pair of aligned pins 140 and 142. The pins 140 and 142 are located on blocks 144 and 146 whose top surfaces stop and support the pallet 22 around the respective holes 136 and 138.

Figure 8:
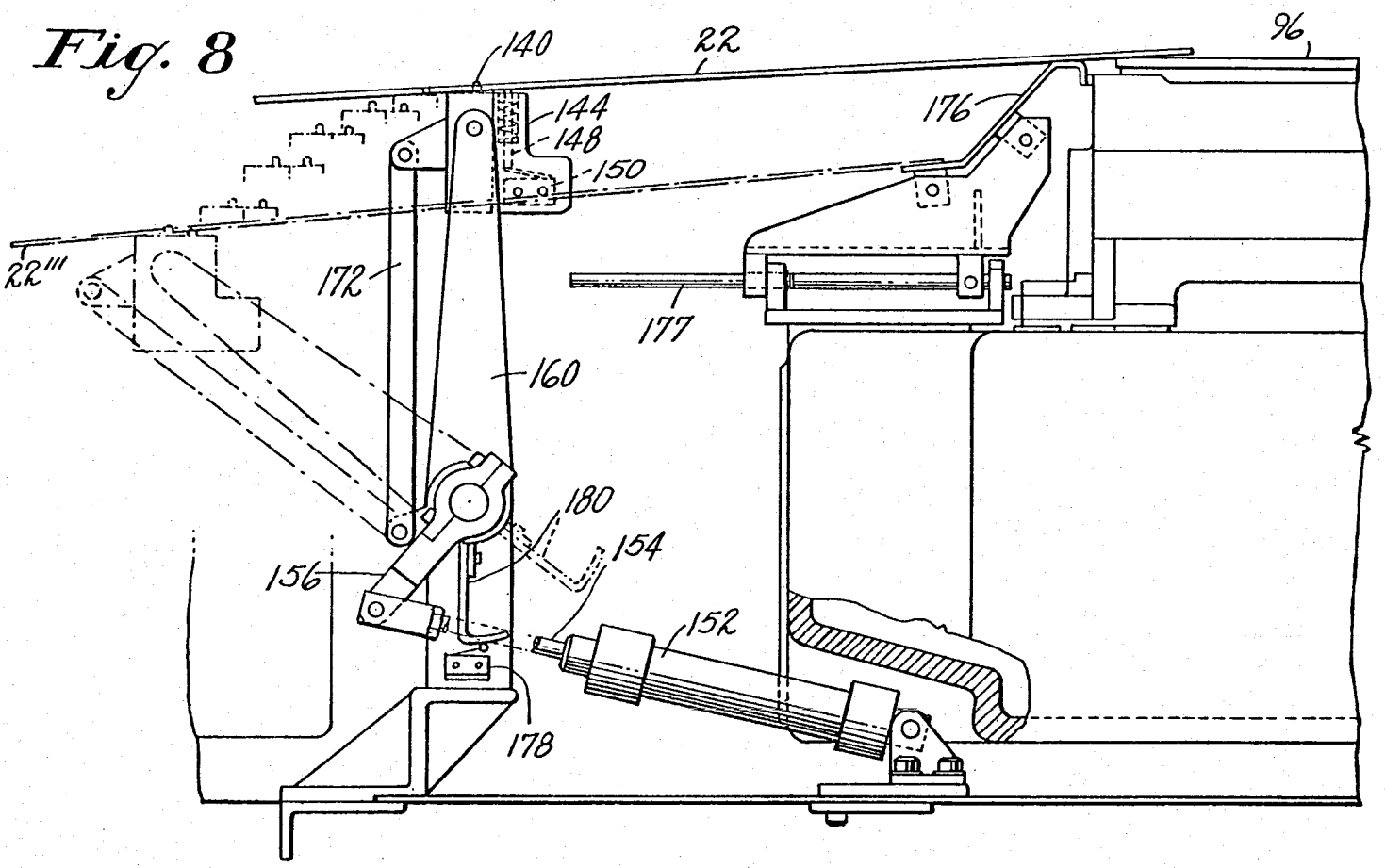
FIG. 8 illustrates the pallet ejector mechanism present within the automatic pallet handling apparatus.

Referring to FIG. 8, the pallet 22 is illustrated as resting on the block 144 with the pin 140 penetrating the hole 136. The block 144 is seen to house a vertical plunger 148 which cooperates with a switch 150 so as to sense the presence of the pallet 22. In other words, when the hole 136 successfully locates over the pin 140, the plunger 148 depresses and closes the switch 150. The switch 150 triggers the automatic control which in turn starts the ejection of the pallet 22. This is accomplished by actuating an air cylinder 152 so as to retract an output shaft 154. The output shaft 154 is pivotally attached to a drive link 156 which is affixed to a shaft 158 of the ejector mechanism. The retraction of the output shaft 154 causes a counterclockwise rotation of the shaft 158. Referring to FIG. 2, the blocks 144 and 146 are seen to be held by a pair of vertical struts 160 and 162 having bases 164 and 166 physically attached to the shaft 158. The shaft 158 in turn is rotatable within a pair of journalled supports 168 and 170 which are affixed to a base 171 illustrated in FIG. 5. The blocks 144 and 146 are pivotally attached to the struts 160 and 162 so as to maintain a proper engagement with the pallet 22 during ejection. The degree of movement of the blocks 144 and 146 with respect to the struts 160 and 162 is limited by a pair of pivotally attached coupling links 172 and 174. In this regard, the coupling links 172 and 174 are each respectively pivotally attached to both the blocks 144 and 146 as well as the journalled supports 168 and 170.

Referring to FIG. 8, the movement of the ejector mechanism 134 during retraction of the output shaft 154 of the air cylinder 152 is illustrated. As has been previously discussed, this causes a rotation of the shaft 158 which in turn moves the struts 160 and 162 outwardly. The ejection path of the block 144 suspended atop the strut 160 and the link 172 is shown in dotted outline form in FIG. 8. The pallet is seen to slide down an adjustable sloped guide surface 176. The sloped guide surface 176 is adjustable along a rail 177 so as to accommodate various sized pallets. When the ejector mechanism 134 has moved the pallet 22 halfway outward, a switch 178 is released by a contact 180 affixed to the shaft 158 as shown in FIG. 2. The contact 180 is configured so as to open the switch 178 when the ejector mechanism 134 is halfway outward. In this regard, the contact 180 actually loses contact with the switch 178 at the halfway point. The contact 180 ultimately assumes a spaced position from the switch 178 as is indicated in dotted outline form. The opening of the switch 178 is a signal to the automatic control that ejection is actually taking place. The pallet is brought outward to a position 22''' that allows the attendant or operator to easily grasp and remove the pallet. This can actually be done during or after the loading of the next pallet into the middle position wherein it is clamped or locked into the carriage 24. In this manner, the sewing machine 20 does not lose valuable time due to the attendant having to immediately handle the completed pallet 22.

Referring to FIG. 9, an automatic digital control system for the pallet handling system 34 is illustrated. The digital control system is seen to include a programmed central processor unit 200 which is connected via an address and data bus 202 to an output port 204, an input port 206, and a keyboard/display controller 208. The central processor receives a clocking signal for internal timing purposes from a clock 209. The central processor unit 200 is preferably an Intel 8085 microprocessor which is an eight bit microprocessor available from the Intel Corporation. The address and data bus 202 is preferably a multibus available from Intel Corporation with the Intel 8085 microprocessor. The output port 204 is preferably an interfacing circuit identifiable as an Intel 8212 circuit which is compatible with the address and data bus 202. In a like manner, the input port 206 is an Intel circuit identifiable as an 8255-A and the keyboard/display controller 208 is an Intel circuit 8279.

The keyboard/display controller 208 interfaces with a keyboard 210 and a display 212. The keyboard can be any of a variety of commercially available keyboards interfacing with the controller 208 via a control bus 214. In this regard, the keyboard/display controller 208 merely scans the eight bits of information available over the control bus 214 and stores the same for subsequent communication with the central processor unit 200 via the address and data bus 202. It is to be noted that the keyboard/display controller 208 will be receiving eight bits of ASCII coded information from the keyboard 210 via the control bus 214. The ASCII code is a standard eight bit binary code for various keys present on commercially available keyboards. It is to be furthermore noted that the keyboard/display controller 208 will transmit keyboard information to the central processor unit 200 in ASCII code. The central processor 200 will convert the thus received information for its internal processing. Any transmittal of information back to the keyboard/display controller 208 will be previously coded in ASCII by the central processor 200. The keyboard/display controller 208 receives the ASCII coded character information from the central processor 200 via the address and data bus 202 and provides character generation information to the display 212 via a display bus 216 in a well-understood manner. It is to be understood that the display 212 can be any of a number of commercially available displays capable of responding to character generation information from the keyboard-/display controller 208.

The output port 204 is seen to have six separate bilevel signal outputs identifiable as 218 through 228. The signals from the bilevel signal outputs 218 through 228 are applied to solid state relays 230, 232, 234, 236, 238 and 240. Each relay respectively converts a logically high bilevel signal applied thereto to a 24 volt AC signal that can be applied to a respective solenoid associated therewith. It is to be understood that each solenoid governs the action of a pneumatic valve associated with one of the pneumatic air cylinders present in the pallet handling system. A valve can either exhaust or admit air into the respective air cylinder in response to the 24 volt AC signal being impressed on its solenoid. The particular air cylinder and corresponding valve action is a matter of arbitrary choice according to the present invention since the bilevel signal condition present on the respective bilevel outputs 218 through 228 can either be set logically high or logically low to accomplish the appropriate action of the air cylinder. In other words, if it is necessary to issue a logically high signal at a particular bilevel output so as to impress a 24 volt AC signal on the corresponding solenoid in order to obtain an extension of the output shaft of the respective air cylinder, then such a signal would issue when the extension was desired. On the other hand, a commercially available pneumatic air cylinder requiring a lack of solenoid excitation for the extension of the output shaft would experience an appropriate logically low signal condition at the corresponding bilevel output. Accordingly, the signal conditions present at the respective bilevel outputs 218–228 will hereinafter be described in terms of the desired effect, namely, extension or retraction of the output shaft of the respective air cylinder.

Referring again to the specific solenoids in FIG. 9, it is to be noted that a solenoid 242 controls the pneumatic action of the air cylinder 70. It will be remembered that the air cylinder 70 dictates the movement of the left shelf 36. In like manner, the solenoid 244 controls the pneumatic air cylinder 94 associated with the right shelf 38. Solenoid 246 is associated with pneumatic air cylinder 98 which controls the withdrawal of the right shelf 38. Solenoid valve 248 is associated with pneumatic air cylinder 110 which controls the pallet clamping mechanism 66. Solenoid valve 250 is associated with air cylinder 128 which controls the movement of the cradle 120. Finally, a solenoid valve 252 controls the air cylinder 152 associated with the pallet ejector mechanism 134.

The input port 206 receives seven logic level signals at bilevel signal inputs 254, 256, 258, 260, 262, 264 and 266. Each bilevel signal input receives a logic level signal from a respective buffer circuit associated with a switch within the pallet handling mechanism 34. Referring first to the bilevel signal input 254, it is seen that a buffer circuit 268 provides a bilevel signal to this input in response to the closing of the switch 86. It will be remembered that the closed switch 86 indicates a downward position of the left shelf 36. The buffer circuit 268 is seen to comprise a noise filter circuit 270 in combination with an optical isolator circuit 272 and a bounce filter circuit 274. The noise filter 270 merely filters the electrical noise from the switch signal whereas the optical isolator 272 provides a further isolated signal that is applied to the conventional bounce filter circuit 274 which samples the signal from the optical isolator and provides an appropriate output signal only when the sampled signal is consistent for a period of time approximating 20 milliseconds. In this manner, an appropriate bilevel signal is applied to the bilevel signal input 254 of the input port 206.

The signal state of the bilevel signal input 254 is preferably logically low for a closed switch condition. In this regard, the switch 86 is preferably an electric switch which generates a logically high signal condition when closed. This signal state is inverted by the various circuits comprising the buffer circuit 268. This results in a logically low signal state at the bilevel signal input 254 for the closed switch condition. It is to be noted that this signal conversion will prevail for the other bilevel signal inputs which are connected through respective buffer circuitry to various switches within the pallet handling system. This signal conversion need not however be followed in practicing the invention if the significance of a given state at a given bilevel input is taken into account within the software program resident within the central processor 200.

A buffer circuit 276 having the same internal configuration as that of buffer circuit 274 is connected to the switch 88. It will be remembered that the switch 88 defines an upward level position of the left shelf 36 when closed. The buffer circuit 276 is operative to produce a logically low bilevel signal to the bilevel signal input 256 in response to a closure of the switch 88.

A buffer circuit 278 processes the signal condition of the switch 131 through to the bilevel signal input 258. It will be remembered that the switch 131 closes when the cradle 120 is positioned outwardly so as to reset the pallet support 80 for subsequent support of a received pallet.

A buffer circuit 280 processes the signal condition of the switch 150 through to the bilevel signal input 260. It will be remembered that the switch 150 closes when the pallet has been engaged by the pallet ejector mechanism 134. This closed switch condition results in a logically low bilevel signal input 260.

A buffer circuit 282 processes the signal condition of the switch 178 through to the bilevel signal input 262. It will be remembered that the switch 178 opens when the pallet has been moved halfway to the extreme outward position by the ejector mechanism 134. This results in a logically high bilevel signal input 262.

A pair of buffer circuits 284 and 286 receive bilevel signals present on the lines 52 and 53 from the pallet identification sensor 50. It will be remembered that the pallet identification sensor 50 is operative to produce either logically high or logically low signal conditions on the lines 52 and 53 in response to particular pallet codes 44. These logic level signal conditions are inverted by the respective buffer circuits 284 and 286 and thereafter presented to the bilevel signal inputs 264 and 266. For the present, it is merely to be noted that the signals on the lines 52 and 53 will be logically low when a pallet is not registered with the pallet identification sensor 50. This will result in logically high signal conditions on the bilevel signal inputs 264 and 266.

As has been previously noted, the buffer circuit 276 is comprised of the same three elements as the buffer circuit 268, namely a noise filter, an optical isolator and a bounce filter. This can also be said of the buffer circuits 278, 280, 282, 284 and 286.

Referring again to the central processor unit 200, it will be remembered that this unit is preferably an Intel 8085 microprocessor. This unit is available with various amounts of randomly addressable memory which is otherwise known as main memory. This main memory normally contains the software programming necessary to operate and respond to the various digital logic present in FIG. 9. The main memory furthermore contains software programming which controls the digital logic necessary to run the motion control system as well as the sewing machine. This latter programming and associated logic do not form part of the present invention. In addition, the main memory includes an allocated portion reserved for the data base utilized by the programs. This data base includes stitch pattern files defining various stitch patterns that are to be sewn on workpieces mounted within the pallets.

The aforementioned programs and data base are normally read into the main memory via one or more tape cassettes. Each tape cassette is inserted into a cassette transport 288 which is driven under the control of a cassette controller 290. The cassette controller 290 transmits the information from the cassette to the main memory of the central processor 200 via the address and data bus 202. The control interfacing whereby information is loaded into the main memory from a tape cassette is well known in the art.

Figure 10:
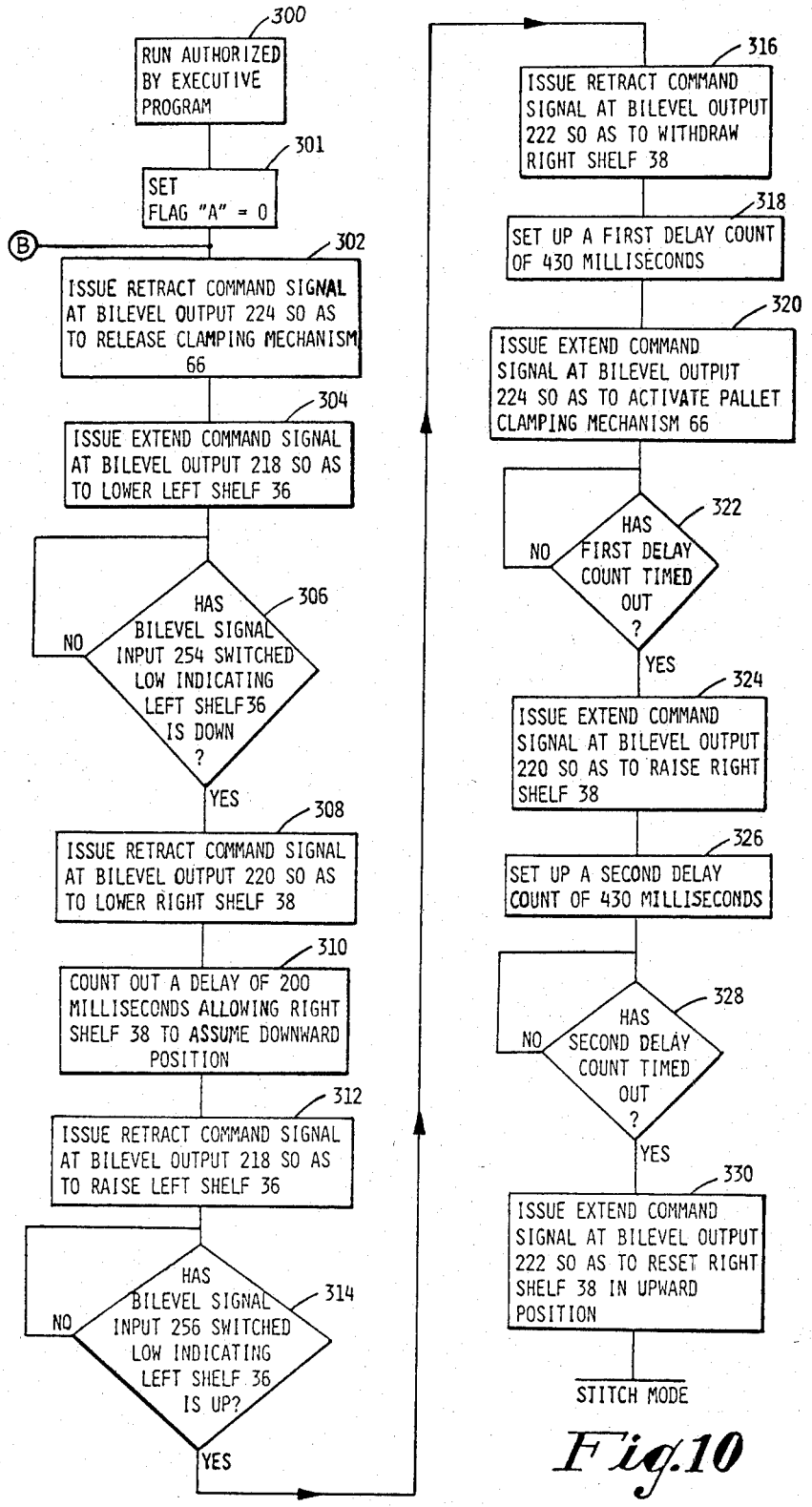
FIG. 10 illustrates the flow of computer commands within the automatic control system of FIG. 9 so as to facilitate the automatic loading of a pallet.

Referring now to FIG. 10, a flow chart of a program resident in the main memory of the central processor 200 is illustrated. This program governs the loading of a pallet into the pallet handling system 34 and will hereinafter be referred to as the PALLET LOAD program. The program begins with a run authorization having been received from an EXECUTIVE program in an initial step 300. The EXECUTIVE program will be described in detail hereinafter. For the present, it is merely to be understood that the EXECUTIVE program will authorize a run when a pallet is in place on the shelves 36 and 38 and a stitch pattern has been prescribed for the loaded pallet.

When the run authorization is received, the central processor 200 proceeds to a step 301 and sets a FLAG A equal to zero. This software flag is utilized by a PALLET UNLOAD program in a manner which will be described hereinafter.

The central processor 200 next issues a RETRACT command signal to the bilevel output 224 of the output port 204 as is indicated by the step 302 in FIG. 10. This is accomplished by specifically addressing the output port 204 and thereafter transmitting an appropriate logic level signal thereto. As has been previously discussed, the signal state of the logic level signal will depend on the configuration of the pneumatic air cylinder that is to be actuated. If the air cylinder is to be exhausted so as to retract the output shaft when the solenoid is deenergized, then the signal at bilevel output 224 will be logically low. On the other hand, if the solenoid must be energized to exhaust the air or if the air must be admitted to retract the output shaft, then the command signal at the bilevel output 224 would be logically high. In any event, the appropriate logic level command signal is generated by the programmed computer and applied to the solid state relay 236. This in turn appropriately energizes or deenergizes the solenoid 248 associated with the air cylinder 110. The net result is that the output shaft 108 of the air cylinder 110 is retracted so as to release the clamping mechanism 66. It is to be noted that the clamping mechanism 66 may already have been released. In this instance, the issuing of the RETRACT command merely is a redundant check on the status of the pallet clamping mechanism 66.

The next step 304 of the central processor 200 is to issue an EXTEND command signal to the bilevel output 218 of the output port 204. This triggers the solid state relay 230 so as to apply a signal condition to the solenoid 242 which allows an outward extension of the shaft 72 associated with the air cylinder 70. Referring to FIG. 4, the outward extension of the shaft 72 results in the left shelf 36 being lowered. The central processor 200 awaits the tripping of the switch 86 which occurs when the left shelf 36 is fully downward. In this regard, the closed switch condition 86 is filtered by the noise filter 270 isolated by the optical isolator 272 and thereafter retained by the bounce filter 274 so as to result in a logically low signal level condition being applied to the bilevel signal input 254. This logically low signal level will be detected by the central processor unit 200 in the step 306 within the flow chart of FIG. 10.

Following a confirmation that the left shelf 36 is down, the central processor 200 issues a RETRACT command signal at the bilevel output 220 of the output port 204 as is indicated by step 308. This RETRACT command triggers the solid state relay 232 so as to apply a signal condition to the solenoid 244 which allows the output shaft 95 of the air cylinder 94 to retract. Referring to FIG. 5, it will be remembered that the retraction of the output shaft 95 of the air cylinder 94 allows the right shelf 38 to be lowered so as to drop the right edge of the pallet from the top input position.

Referring again to the flow chart of FIG. 10, it is noted that the central processor unit counts out a delay of 200 milliseconds in a step 310. This defines an appropriate time for the right shelf 38 to assume the downward position. It is to be noted that the counting out of the delay is accomplished by establishing a count and thereafter decrementing the count by the clock signal from the clock 209.

Following the assumption of a downward position by the right shelf 38, the central processor 200 in a step 312 issues a RETRACT command signal at the bilevel output 218 of the output port 204. This reverses the signal state of the solid state relay 230 so as to apply a signal condition to the solenoid 242 which allows the output shaft 72 associated with the air cylinder 70 to retract and hence raise the left shelf 36. Referring to FIG. 4, the switch 88 is contacted when the left shelf assumes an upward position. The closed signal state of the switch 88 results in a logically low signal state being applied to the bilevel input 256 via the buffer circuit 276. This logically low signal state at the bilevel input 256 is noted by the central processor 200 which addresses the input port 206 and asks whether the bilevel signal input signal 256 has switched low. This is accomplished in a step 314 in FIG. 10.

The central processor 200 next issues a RETRACT command signal in a step 316 to the bilevel output 222 of the output port 204. Referring to FIG. 9, the relay 234, associated with the bilevel output 204, provides a signal condition on the solenoid 246 which results in a retraction of the output shaft of the air cylinder 98. As is seen in FIG. 5, this results in a withdrawal of the right shelf 38. This latter movement of the right shelf 38 allows for an appropriate clearance of the pallet 22 which now rests on the reference base 96. This constitutes the middle position for a pallet within the pallet handling system.

Referring again to FIG. 10, it is seen that the central processor 200 sets up a first delay count of 430 milliseconds in a step 318 following the issuance of the RETRACT command signal at the bilevel output 222. It will be remembered that the clock 209 provides a clock signal to the central processor 200 for the purpose of timing out a delay established by the central processor 200. White the central processor is thus timing out the delay, it also issues an EXTEND command signal in a step 320 to the bilevel output 224 of the output port 204. This triggers the solid state relay 236 so as to apply a signal condition to the solenoid 248 which causes the output shaft 108 of the air cylinder 110 to move outwardly. Referring to FIG. 6, this results in the pivotal lever 102 rotating about the axis 114 so as to apply a clamping pressure to the pallet which has been previously dropped onto the pallet supports 80 and 82. As a result of the clamping action, the pallet is now mated to the carriage 24 and is ready for subsequent positioning under the sewing machine head 20. Before any such positioning can occur, it is first of all necessary for the first delay count to have timed out indicating that the right shelf 38 has in fact reached a withdrawn position. This is provided for by the step 322 calling for the delay count to have been timed out in FIG. 10.

Following the timing out of the first delay, the central processor 200 is operative in a step 324 to issue an EXTEND command signal to the bilevel output 220 of the output port 204. This command triggers the solid state relay 232 so as to apply a signal condition to the solenoid 244 which causes the output shaft 95 of the air cylinder 94 to extend upwardly. This in turn causes the right shelf 38 to move upwardly as is shown in FIG. 5. The central processor 200 sets up a second delay count of 430 milliseconds in a step 326 and times out the second delay count so as to allow adequate time for the movement of the output shaft 95 of the air cylinder 94. The timing out is accomplished by a step 328 which utilizes the clocking signal from the clock 209 to time out the count of 430 milliseconds established in the step 326.

The central processor thereafter in a step 330 issues an EXTEND command signal at the bilevel output 222 of the output port 204. This triggers a solid state relay 234 so as to apply a signal condition to the solenoid 246 which causes an outward extension of the output shaft 97 of the air cylinder 98 as is shown in FIG. 5. This constitutes the final step in resetting the right shelf 38 to its upward position. The central processor 200 has now sequenced the left shelf 36 and right shelf 38 through a complete set of movements so as to drop the pallet to the middle position within the pallet handling system 34. The central processor 200 has moreover clamped the thus delivered pallet to the carriage 24 and reset both the left shelf 36 and the right shelf 38. This will allow for the loading of an additional pallet onto the thus reset shelves.

The central processor 200 is operative to call for the movement of the clamped pallet while another pallet is being loaded onto the reset shelves 36 and 38. In accordance with the invention, the movement of the pallet can actually occur as early as the end of step 320. At this point, the withdrawing of the right shelf 38 does not interfere with the movement of the pallet 22. The resetting of the right shelf 38 from a withdrawn and lowered position, as dictated by steps 324 to 330, will also not interfere with the movement of the pallet. The only requirement relative to the initial movement of the pallet is that the carriage 24 first be moved along the axis 26 in the Y-direction toward the sewing machine head 20. This initial movement will disengage the heel 118 of the pallet support from the cradle 120 in FIG. 6.

It is to be appreciated that a motion control program for the aforementioned movement resides in the main memory of the central processor 200. This motion control program utilizes a stored file of stitch pattern information which dictates the synchronized movement of the pallet containing a workpiece underneath a reciprocating sewing needle within the sewing head 20. This is identified broadly as the STITCH MODE in FIG. 10. Following the successful execution of a desired stitch pattern, the pallet containing the finished workpiece is returned to the position illustrated in FIG. 6. This requires a final movement of the carriage 24 along the axis 26 so as to reposition the heel 118 of the pallet support within the cradle 120. This is preparatory to further processing of the clamped pallet by the pallet handling system.

Figure 11:
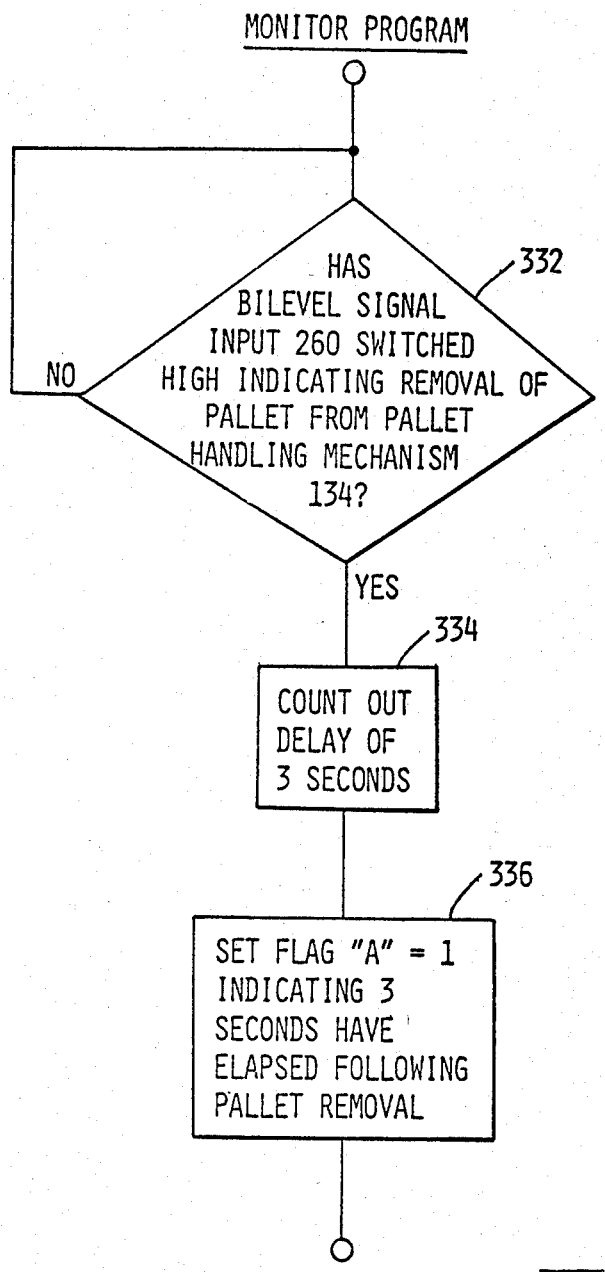
FIG. 11 illustrates the flow of computer commands within the automatic control system of FIG. 9 so as to monitor the removal of an ejected pallet.

Referring now to FIG. 11, a MONITOR program is illustrated in flow chart form. This MONITOR program resides in the central processor unit 200 and is moreover active during the aforementioned stitching mode. In this regard, the MONITOR program is periodically executed for the purpose of ascertaining the status of any pallet that is to be removed by the operator or machine attendant. It will be remembered that the pallet handling system 34 has the capability of moving a finished pallet to an outward position for removal by the operator. The control for this particular processing of the pallet will be explained in detail hereinafter. For the moment, it is merely necessary to note that a pallet may in fact be present on the pallet handling mechanism 134. In this regard, the MONITOR program of FIG. 11 begins with a step 332 wherein the central processor 200 addresses the input port 206 and asks whether or not the bilevel signal input 260 has been switched high. Referring to FIG. 8, it will be remembered that a pallet resting on the block 144 of the pallet handling mechanism 134 will cause a plunger 148 to close a switch 150. This closure of the switch 150 will be processed by the buffer circuit 280 so as to produce a logically low signal condition at the bilevel input 260. As long as this logically low signal condition exists, the central processor 200 merely addresses the bilevel signal input 260 and does nothing further. On the other hand, when the bilevel signal input 260 switches logically high, the central processor 200 counts out a delay of three seconds as is indicated in a step 334 in FIG. 10. This is accomplished by setting up a count of three seconds and allowing the clock 209 to decrement the count to zero. At this time, the central processor sets a FLAG A equal to binary one in a step 336. This provides an indication that three seconds have elapsed following removal of the pallet by the operator. As will become apparent hereinafter, this three second delay is used to trigger the resetting of the pallet ejector mechanism 134. The lapse of three seconds allows the operator sufficient time to remove the pallet before the pallet ejector mechanism 134 begins this reset motion.

Figure 12A:
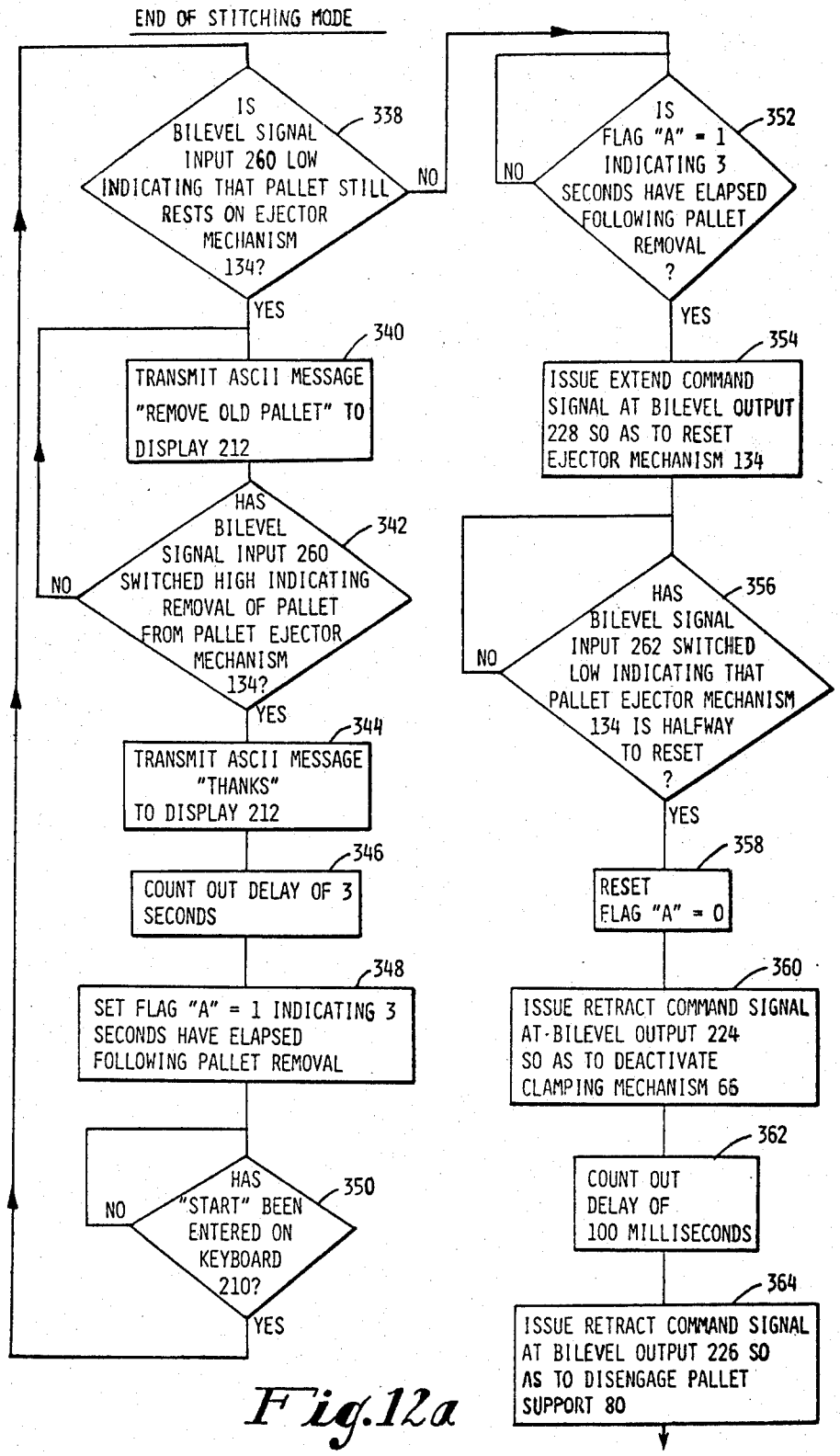
FIGS. 12*a* and 12*b* illustrate the flow of computer commands within the automatic control system of FIG. 9 so as to facilitate the unloading of a pallet.
Figure 12B:
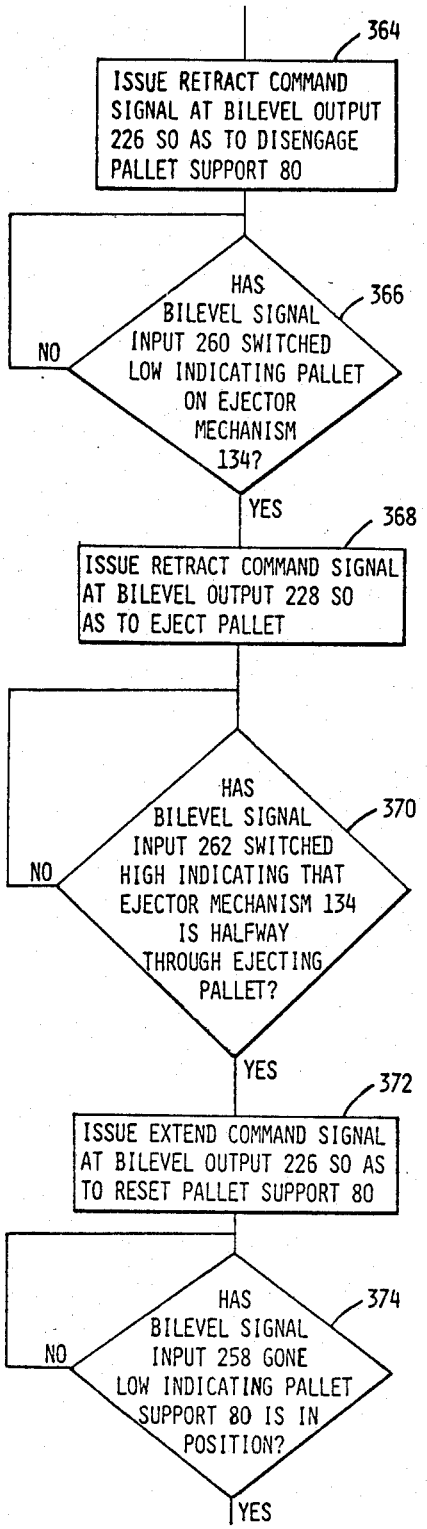

Referring now to FIGS. 12*a* and 12*b*, a flow chart depicts a PALLET UNLOAD program which dictates the sequential operation of the central processor 200 during a pallet unloading sequence. In this regard, a previously loaded pallet has been presented to the sewing machine head 20 for sewing and is now ready for the pallet unloading sequence. This is indicated by an end of stitching mode notation in FIG. 12*a*. It is to be understood that the end of stitching mode juncture depicted in FIG. 12*a* would include the repositioning of the heel 118 of the pallet support within the cradle 120 as is shown in FIG. 6.

The first inquiry made by the central processor 200 is to ask whether the bilevel signal input 260 is logically low in a step 338. It will be remembered from the previous discussion of FIG. 11, that the bilevel signal input 260 is logically low when the switch 150 associated with the pallet handling mechanism 134 is closed indicating that a pallet still rests on the ejector mechanism 134. If the pallet has not been removed by the operator during the course of the stitching mode, then the central processor 200 follows the "YES" path in FIG. 12*a* to a step 340 and transmits the ASCII coded message "REMOVE OLD PALLET" to the display 212. As has been previously discussed, the central processor 200 communicates with the keyboard/display controller 208 over the address and data bus 202 in the standard ASCII code. The keyboard/display controller 208 in turn transmits character generator signals over a display bus 216 to the display 212. The message is thereafter displayed in normal fashion on the display 212.

The central processor 200 now asks in step 342 whether the bilevel signal input 260 has switched high indicating removal of the pallet from the pallet handling mechanism 134. If the pallet still remains on the pallet handling mechanism 134, the "NO" path is pursued back to step 340 and the "REMOVE OLD PALLET" message is again transmitted to the display 212. The bilevel signal input 260 will again be addressed by the central processor 200 to ascertain whether or not the input signal has switched logically high indicating the removal of the pallet from the pallet handling mechanism 134. When this finally occurs, the "YES" path is pursued and the central processor 200 transmits ASCII message "THANKS" to the display 212 in a step 344. The central processor 200 now counts out a delay of three seconds in a step 346 and thereafter sets a FLAG A equal to binary one in a step 348. It will be remembered that this sequence of steps assures that the operator will be allowed sufficient time to remove the pallet.

Following the setting of the FLAG A equal to one, the central processor thereafter asks the keyboard/display controller 208 in a step 350 whether or not a "START" has been entered on the keyboard 210. The central processor 200 awaits the "START" signal from the keyboard 210 before following the "YES" path back to step 338. It will be noted that the loop which has just been discussed is premised on the pallet not having been unloaded at the end of the stitching mode. This requires that the machine be again started by the operator as is evidenced by the step 350 requiring a "START" authorization again. This program loop is avoided if the pallet has been previously removed prior to the end of stitching mode. In this regard, the bilevel signal input 260 will be logically high causing a "NO" answer to the inquiry by the central processor 200 in step 338. The "NO" path will hence be followed from the step 338 to a step 352 in FIG. 12*a*. The step 352 calls for the central processor 200 to ask whether or not the FLAG A is equal to one indicating that three seconds have elapsed following removal of the pallet. It will be remembered that the FLAG A does not indicate a binary one signal condition until three seconds have elapsed so as to allow the operator to remove the pallet. This could still be timing out in the event that the MONITOR program began counting out three seconds towards the end of the stitching mode. In any event, the central processor 200 awaits the setting of the FLAG A equal to one. When this occurs, the central processor in a step 354 issues an EXTEND command signal at the bilevel output 228 of the output port 204. Referring to FIG. 9, the presence of an EXTEND command signal at the bilevel output 228 triggers the solid state relay 240 so as to apply a signal condition to the solenoid 252 which causes the output 154 of the air cylinder 152 to extend. This extension of the output 154 of the air cylinder 152 causes the ejector mechanism 134 to rotate backwardly to its reset position.

The central processor 200 next asks in a step 356 whether the bilevel signal input 262 has switched low. Referring to FIG. 9, it is seen that the bilevel signal input 262 receives a buffered signal from the switch 178 through the buffer circuit 282. The switch 178 closes when the ejector mechanism 134 has moved inward halfway. This closed switch condition will result in the logically low signal state being indicated at the bilevel input 262. When the ejector mechanism has thus been sensed as having moved halfway inwardly, the central processor 200 resets the FLAG A equal to zero in a step 358.

The central processor 200 next issues a RETRACT command signal to the bilevel output 224 of the output port 204 in step 360. This triggers the solid state relay 236 so as to apply a signal condition to the solenoid 248 resulting in the retraction of the output shaft 108 associated with the air cylinder 110. This deactivates the clamping mechanism 66 as has been previously discussed with regard to FIG. 7. Specifically, the wedge 62 is disengaged from the groove 58 of the pallet 22. The pallet now merely lies on the pallet supports 80 and 82 as well as the reference base 96. Referring again to FIG. 12*a*, the central processor 200 assures that the aforementioned action has occurred by counting out a delay of 100 milliseconds in a step 362 following issuance of the RETRACT command to the bilevel output 224 in step 360. When the delay has thus been timed out, the central processor in a step 364 issues a RETRACT command signal to the bilevel output 226 of the output port 204. Referring to FIG. 9, the RETRACT command signal present at the bilevel output 226 triggers the solid state relay 238 so as to apply an appropriate signal condition to the solenoid 250. This allows the output 129 of the air cylinder 128 to retract so as to cause the cradle 120 housing the heel 118 of the pallet support to move backward in the manner shown in FIG. 7. The toe of the pallet support 80 is moved out from underneath the pallet so as to allow the pallet to drop downward at its front edge.

Referring now to FIG. 12*b*, it is seen that the flow chart depicted therein is a continuation of the sequential logic illustrated in FIG. 12*a*. In particular, it is to be noted that the first step of FIG. 12, namely, step 364 is merely a repeat of the last step performed by the central processor 200 in FIG. 12*a*. The next step 366 to be implemented by the central processor in FIG. 12*b* is that of asking whether or not the bilevel signal input 260 has switched low. Referring to FIG. 9, it is seen that the bilevel signal input 260 receives a buffered signal from the switch 150. The bilevel signal input will be logically low when the switch 150 has closed. It will be remembered from the discussion of FIG. 8 that the switch 150 is closed when a pallet rests on the pallet ejector mechanism. When this condition occurs, the "YES" path is pursued in FIG. 12*b*. The central processor 200 next issues a RETRACT command at the bilevel output 228 in a step 368. This RETRACT command present at the bilevel output 228 triggers a solid state relay 240 so as to apply a signal condition to the solenoid 252 which retracts the output shaft 154 of the air cylinder 152 in FIG. 8. This retraction causes the ejector mechanism 134 to move outwardly so as to transport the pallet to a position whereby it may be removed by the operator of the machine. The outward ejection motion is monitored by the central processor 200 in a step 370 which asks whether the bilevel signal input 262 has switched logically high. In this regard, the switch 178 switches open when the pallet ejector mechanism 134 is halfway through its outward motion. When the bilevel signal input 262 has switched high, the central processor 200 issues an EXTEND command to the bilevel output 226 in a step 372. Referring to FIG. 9, this triggers the solid state relay 238 so as to apply a signal condition to the solenoid 250 which extends the output 129 of the air cylinder 128. This causes the cradle 120 to engage the heel 118 of the pallet support so as to move the pallet support 80 back into a reset position. This position is illustrated in FIG. 6. The reset position of the pallet support 80 allows a pallet to be supported between the pallet support 80 and the pallet support 82. Referring to step 374 of FIG. 12*b*, the central processor 200 checks to see whether or not the pallet support 80 is in fact in position. This is accomplished by asking whether or not the bilevel signal input 258 has gone logically low. In this regard, the switch 131 associated with the cradle 120 will have closed when the output shaft 129 is fully extended. When this signal condition occurs, the central processor 200 proceeds "to the EXECUTIVE program". As will be explained in detail hereinafter, the EXECUTIVE program is operative to process a pallet present on the shelves 36 and 38 when a valid stitch pattern file has been assigned to the pallet.

The sensing of a pallet by the aforementioned EXECUTIVE program is premised on a sensing of the pallet identification code. It will be remembered from the discussion of the pallet identification code 44 in FIG. 3 that two separately coded surface areas 46 and 48 are presented underneath a pair of optical sensors in the pallet identification sensor device 50. The coded surface area 46 is sensed by one optical sensor which produces a bilevel signal on the line 52. The coded surface 48 is sensed by the other optical sensor which produces a bilevel signal on the line 53. The coded surfaces 46 and 48 may each either be opaque or reflective. A reflective surface produces a logically high signal condition on the respective line 52 or 53 whereas an opaque surface produces a logically low signal condition. These signal conditions are inverted by the respective buffer circuits 284 and 286 in FIG. 9 so as to produce the reverse signal condition at the bilevel inputs 264 and 266. Attaching a binary one significance to a logically high bilevel signal input and a binary zero to a logically low bilevel signal input results in the following binary significance relative to the coded surfaces 46 and 48:

| Coded Surface 46 (line 52) | Coded Surface 48 (line 53) | Bilevel Signal Input 264 | Bilevel Signal Input 266 |
|---|---|---|---|
| Opaque | Reflective | 1 | 0 |
| Reflective | Opaque | 0 | 1 |
| Reflective | Reflective | 0 | 0 |

As has been previously noted, the condition wherein both areas are non-reflective is reserved for a "no-pallet present" situation. The EXECUTIVE program will attach a numerical significance to each of the above two bit binary code combinations in a manner which will be described hereinafter. The EXECUTIVE program will moreover assure that one or more particular stitch pattern files are assigned to each thus identified pallet. This assignment of a stitch pattern files to a pallet is accomplished through interactive communication with the operator as set forth in a sub program within the EXECUTIVE program. This as well as other features of the EXECUTIVE program will be more fully appreciated during the descr1ption of the program hereinafter. In this regard, the EXECUTIVE program appears in flow chart form in FIGS. 13*a*, 13*b*, 13*c*, 13*d* and 13*e*. It is to be noted that the ends of a first figure may be matched with the beginnings of a next figure by merely matching up the alphabetic labels on the flow chart lines of the respective figures.

Figure 13A:
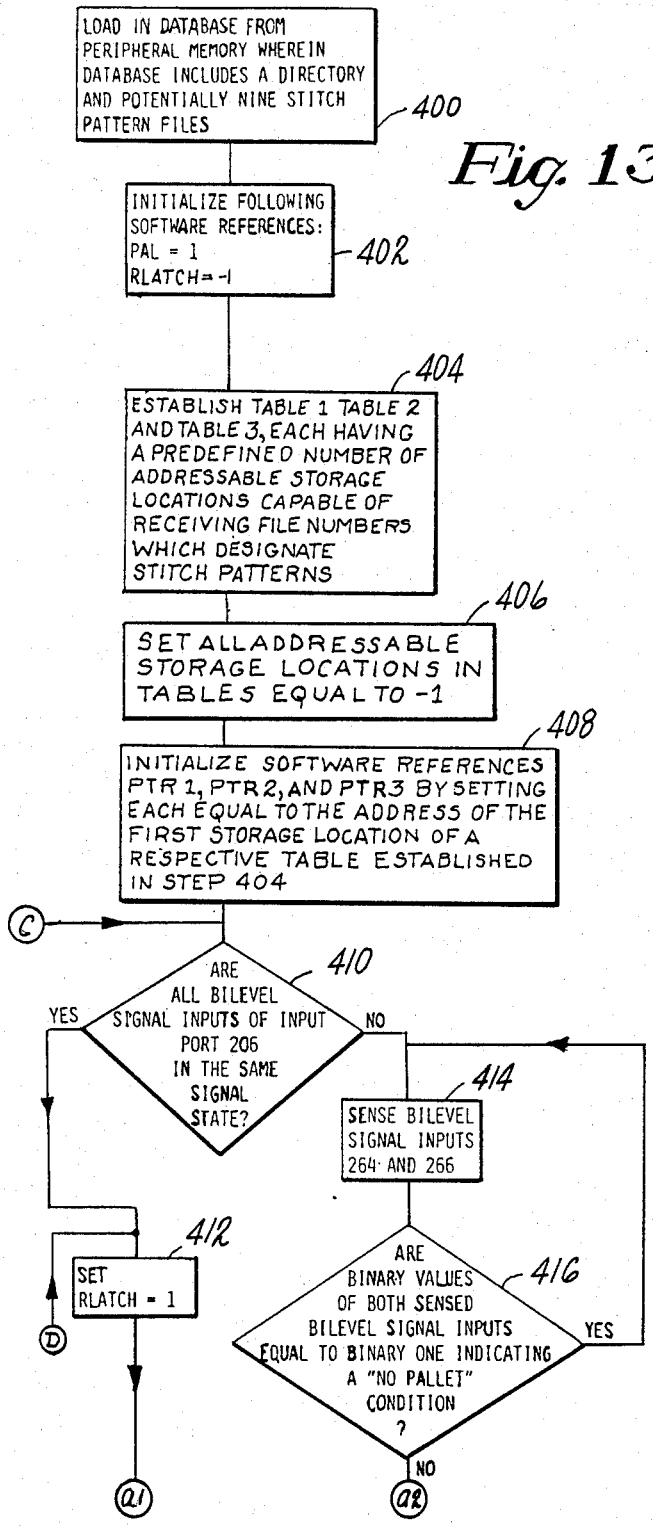
FIGS. 13*a* through 13*e* illustrate program logic within the computer of FIG. 9 that facilitates the automatic processing of pattern files.

Referring to FIG. 13*a*, the EXECUTIVE program begins with a pre-processing step 400 wherein a database is loaded from a peripheral memory into the main memory of the central processor 200. This peripheral memory preferably consists of a cassette system comprising a cassette transport driven under the control of a cassette controller. Such a peripheral memory system is illustrated in FIG. 9. It is noted that the cassette controller 290 communicates with the central processor 200 via the address and data bus 202. Cassette systems having the capability to communicate via an address and data bus with a central processor are well known in the art. The database which is thus loaded into the main memory of the central processor 200 via the bus 202 preferably includes up to nine separate stitch pattern files and a directory for these files. Each stitch pattern file preferably comprises one or more blocks of data wherein a block of data preferably equals 256 eight bit bytes of information. Each block of data contains X and Y motion information for the carriage 24 as well as instructions for the synchronized movement of the sewing needle within the sewing head 20. The directory for the nine stitch pattern files includes at least two bytes of information per file. The first byte is a numerical index for the first block of data of the file. The second byte indicates the number of data blocks that have been allocated to the particular file. It is to be appreciated that the directory will comprise a minimum of only eighteen bytes of information if nine stitch pattern files are to be maintained. Directory information for each numbered stitch pattern file is easily obtained by merely noting where the first directory byte is stored and thereafter counting up in multiples of two to the desired two bytes of directory information.

It is to be understood that while a particular database has been described, various other approaches to organizing the storage of stitch pattern files may also be used with the present invention. For instance, a series of stitch pattern files occupying consecutively addressable storage locations could also be used together with a directory containing the first address for each stitch pattern file and the number of addressable storage locations set aside for that file.

The next step 402 illustrated in FIG. 13*a* is that of initializing two software references which are to be used within the program. The first of these software references, namely, PAL is utilized for the purpose of assigning a stitch pattern file to a particular pallet. The other software reference, namely, RLATCH is utilized within the EXECUTIVE program as a run authorization. The use of these software references will be more fully understood hereinafter. For the present, it is merely to be noted that a setting of the RLATCH equal to minus one will assure that a run authorization does not occur.

The next step 404 within the executive program is to establish three separate tables denoted as TABLE 1, TABLE 2 and TABLE 3. Each of these tables is to have a predefined number of addressable storage locations capable of receiving file numbers which designate stitch pattern files. In the particular embodiment disclosed herein, file numbers will range from "1" through "9". The predefined number of addressable storage locations can hence be arbitrarily set at nine so as to allow each table to accommodate all nine file numbers. It is to be noted that in most instances, a table will actually have considerably less than all nine file numbers. The number of stitch pattern files in a table is normally a function of how many different sewing patterns are to be sewn on a workpiece prearranged within a pallet having a given code. For instance, a workpiece may only require three different stitch patterns to complete all sewing requirements. In this instance only three of the nine addressable storage locations in a table associated with that pallet code would be utilized.

All of the addressable storage locations in the thus established tables of step 404 are initially set equal to minus one in a step 406. The negative one condition of an addressable storage location within a table will be utilized as an indication that a file number has not been assigned thereto.

Step 408 sets up software references PTR 1, PTR 2, and PTR 3. These particular software references will be utilized to point to addressable storage locations within the respective tables established in step 404. Each pointer is initially set equal to the first addressable storage location in a respective table. This will mean that the first, tenth and eighteenth addressable storage locations in a set of twenty seven consecutive addressable storage locations set aside for the tables will constitute the initial pointer values of PTR 1, PTR 2, and PTR 3. As will become apparent hereinafter, a pointer can always be changed within the program so as to contain the address of the storage location which is next desired within a given table. This is normally accomplished by incrementing the pointer by one. This incrementing normally continues until an addressable storage location is encountered that has a stored value of minus one indicating that not all addressable storage locations have been utilized within the table. On the other hand, the incrementing can continue until the ninth addressable storage location is encountered. In either instance, the respective pointer is returned to the initialized pointer address value established in step 408.

The next step 410 within the EXECUTIVE program is to ask whether all bilevel inputs of input port 206 are logically high. This step is merely asking whether an operative automatic pallet handling system 34 has been connected to the central processor unit 200. In this regard, it is impossible for all bilevel inputs to maintain the same signal state in the event that a pallet handling system is appropriately connected. In this regard, it will be remembered that for instance the signal states of the bilevel inputs 254 and 256 can never be in the same signal state. In other words, the switches 86 and 88 associated with these particular bilevel inputs cannot be both simultaneously closed since they each represent different positions of the left shelf 36. In the event that all bilevel signal states agree, the YES path is pursued and the RLATCH reference is set equal to one in a step 412. This setting assures that the machine will not merely run in an automatic mode on the presumption that pallets are being sequenced through a pallet handling system. On the other hand, the machine can be operated in a manual mode in a manner which will be apparent hereinafter. This allows for the manual operation of the machine utilizing the EXECUTIVE program even without a properly functioning pallet handling apparatus or without any pallet handling apparatus.

In the event that an automatic pallet handling system with associated switches is appropriately connected to the input port 206, the NO path will be pursued out of step 410 to a step 414. Step 414 requires the central processor 200 to specifically sense the bilevel signal inputs 264 and 266. It will be remembered that a set of logically high signal conditions at both bilevel inputs 264 and 266 indicate that a pallet has not been presented to the pallet identification sensor device 50. In this regard, the central processor 200 is operative to check for this condition in a step 416 by asking whether or not the binary values of both bilevel signal inputs are binary one indicating a no pallet condition. If in fact a pallet has not been registered, then the YES path is pursued back to step 414 and the central processor again senses the bilevel signal inputs until such time as a pallet has been registered.

Figure 13B:
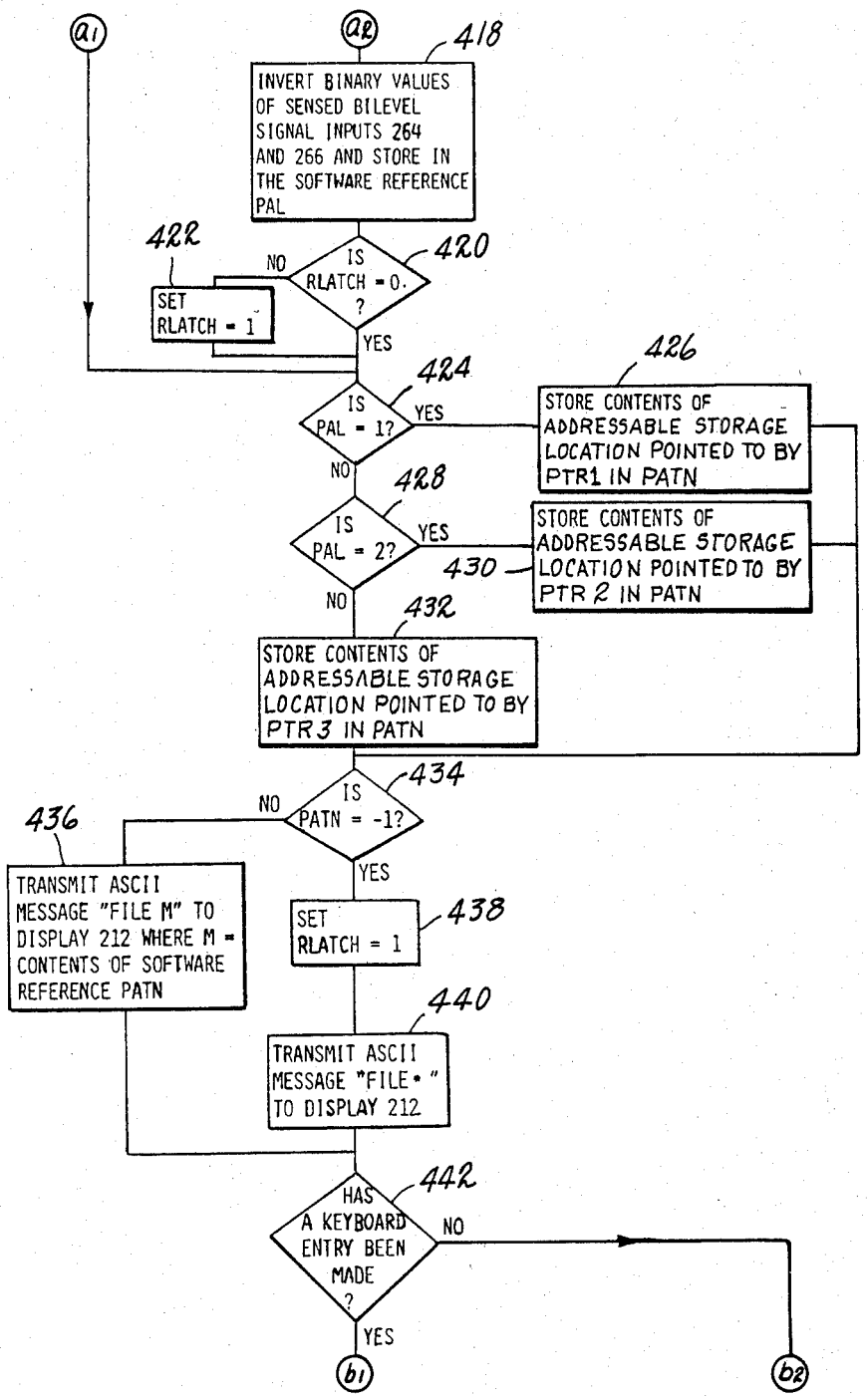

Referring again to step 416 in FIG. 13*a*, if a pallet is sensed, then the NO path is pursued to a next step 418 in FIG. 13*b* wherein the binary values of the sensed bilevel signal inputs 264 and 266 are inverted and thereafter stored in the software reference PAL. Referring to the binary values present at the bilevel inputs 264 and 266, it will be remembered that the following combinations of binary zeroes and ones may occur:

| Input 264 | Input 266 |
|---|---|
| 1 | 0 |
| 0 | 1 |
| 0 | 0 |

It is to be appreciated that the inversion accomplished in step 422 will result in the following correspondence between the stored binary in PAL and the bilevel inputs 264 and 266:

| Input 264 | Input 266 | PAL |
|---|---|---|
| 1 | 0 | 01 |
| 0 | 1 | 10 |
| 0 | 0 | 11 |

It is to be appreciated that the above two bits of stored binary in PAL represent numerical values one, two and three in decimal. Accordingly, the stored two bits in PAL will be treated by the programmed central processor 200 as identifying either a pallet 1, pallet 2 or pallet 3. On the other hand, the operator of the machine will recognize a pallet 1, 2 or 3 by the following combinations of coded surfaces:

| Pallet Number | Coded Surface 46 | Coded Surface 48 |
|---|---|---|
| 1 | Opaque | Reflective |
| 2 | Reflective | Opaque |
| 3 | Reflective | Reflective |

It is to be appreciated that the above numerical significance attaching to the coded surfaces 46 and 48 is arbitrary. Other encodings could occur with the ultimate numerical significance attaching to the encodings being decoded as decimal one, two, and three in the PAL software reference.

Referring again to FIG. 13*b*, the central processor proceeds from step 418 to a step 420 and asks for the signal status of RLATCH. If RLATCH is equal to zero, indicating an automatic mode of operation, then the "YES" path is pursued. On the other hand, if the RLATCH is other than zero, then it is set equal to one in step 422. It is to be noted that the path pursued after setting the RLATCH equal to one in step 412 also now converges.

The next sequence of steps is to basically associate the stored numerical pallet code in PAL with one of the three tables, TABLE 1, TABLE 2, or TABLE 3. In this regard, step 424 asks whether the bit contents of the software reference PAL are equal to one. If the answer is YES, then step 426 is pursued and the central processor 200 stores the contents of the addressable storage location in TABLE 1 currently pointed to by PTR 1 in a software reference PATN. It is to be appreciated that the contents of this addressable storage location will initially be minus one. On the other hand, this addressable storage location will ultimately contain a binary representation of a particular file number that will be entered later on in a TABLE ENTRY program which will be explained in detail hereinafter. In like manner, steps 428 and 430 ask whether or not the numerical pallet code stored in the software reference PAL is equal to two and if YES, the bit contents of the addressable storage location in TABLE 2 currently pointed to by PTR 2 are stored in the software reference PATN. In the event that a NO answer is obtained to the question posed in step 428, then the central processor proceeds to a step 432 and stores the bit contents of the addressable storage location currently pointed to by PTR3 in the software reference PATN since this is the only other possible numerical pallet code. At this point in time, the software reference PATN has either the bit contents of an addressable storage location from TABLE 1, TABLE 2 or TABLE 3 stored therein as a result of steps 424 through 432.

The next step 434 is to ask whether the software reference PATN is equal to minus one. This will in fact be the case initially as none of the tables will have anything other than a minus one. On the other hand, if at least one stitch pattern file has been previously assigned to a pallet in a manner which will be described hereinafter, then the NO path is pursued out of step 434. In this event, the central processor 200 executes a step 436 wherein an ASCII message is transmitted to the display 212 which begins with the word "FILE" and thereafter the numerical designation "M" which represents the bit contents of the software reference PATN. In this regard, the software reference PATN will have the bit contents of the particular addressable storage location pointed to as a result of steps 426, 430, or 432.

In the event that at least one stitch pattern file has not been assigned to the sensed pallet, then the YES path will be pursued out of step 434. The central processor 200 now sets RLATCH equal to one in step 438 so as to assure that an automatic run will not occur if a file has not in fact been assigned. The central processor next transmits in a step 440 the ASCII message "FILE*" to display 212. This communication to the operator of the machine indicates that a file has not been assigned to the pallet that is thus registered under the sensor 50.

Accordingly, the central processor 200 asks the keyboard display controller 208 whether a keyboard entry has been made on the keyboard 210. This is step 442. It is to be noted that the central processor 200 asks whether or not a keyboard entry has been made regardless of whether or not step 436 has been executed. In this manner, an opportunity is allowed for changing the assigned stitch pattern file which has been previously indicated to the operator in step 436. If a keyboard entry has not been made following display of messages in either steps 436 or 440, then the NO path is pursued from step 442 in FIG. 13*b* to a step 444 in FIG. 13*c*. Step 444 inquires as to the status of the software reference RLATCH. It will be remembered that RLATCH is initially set equal to minus one in step 402. It is also to be noted that RLATCH is set equal to one in a step 412 if a pallet handling system is not detected in step 410. In either of these cases, the NO path will be pursued out of step 444 back through a common return junction "C" to step 410. The central processor will hence remain in a loop defined by the NO path out of step 444 until the RLATCH is set equal to zero in a manner which will hereinafter be described.

Figure 13C:
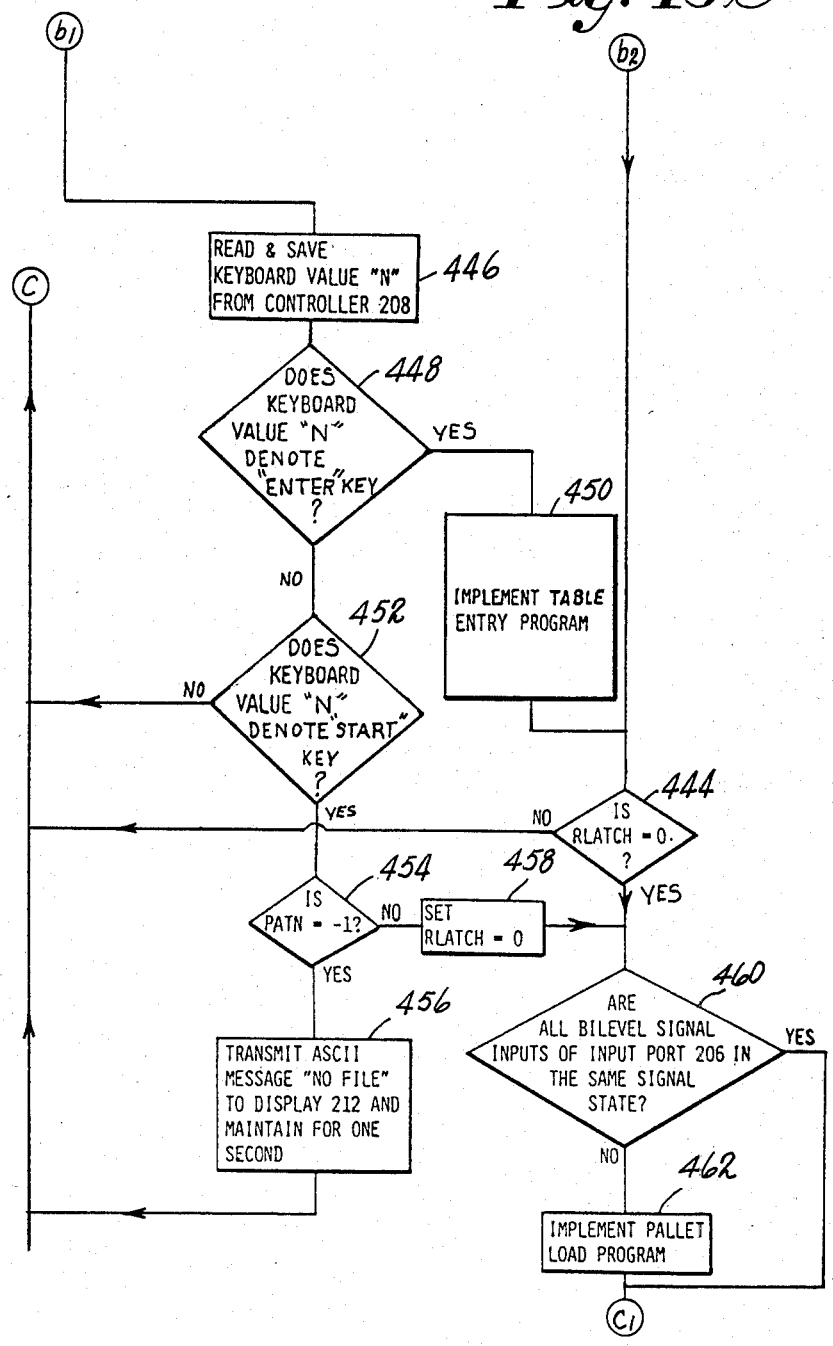
Figure 13D:
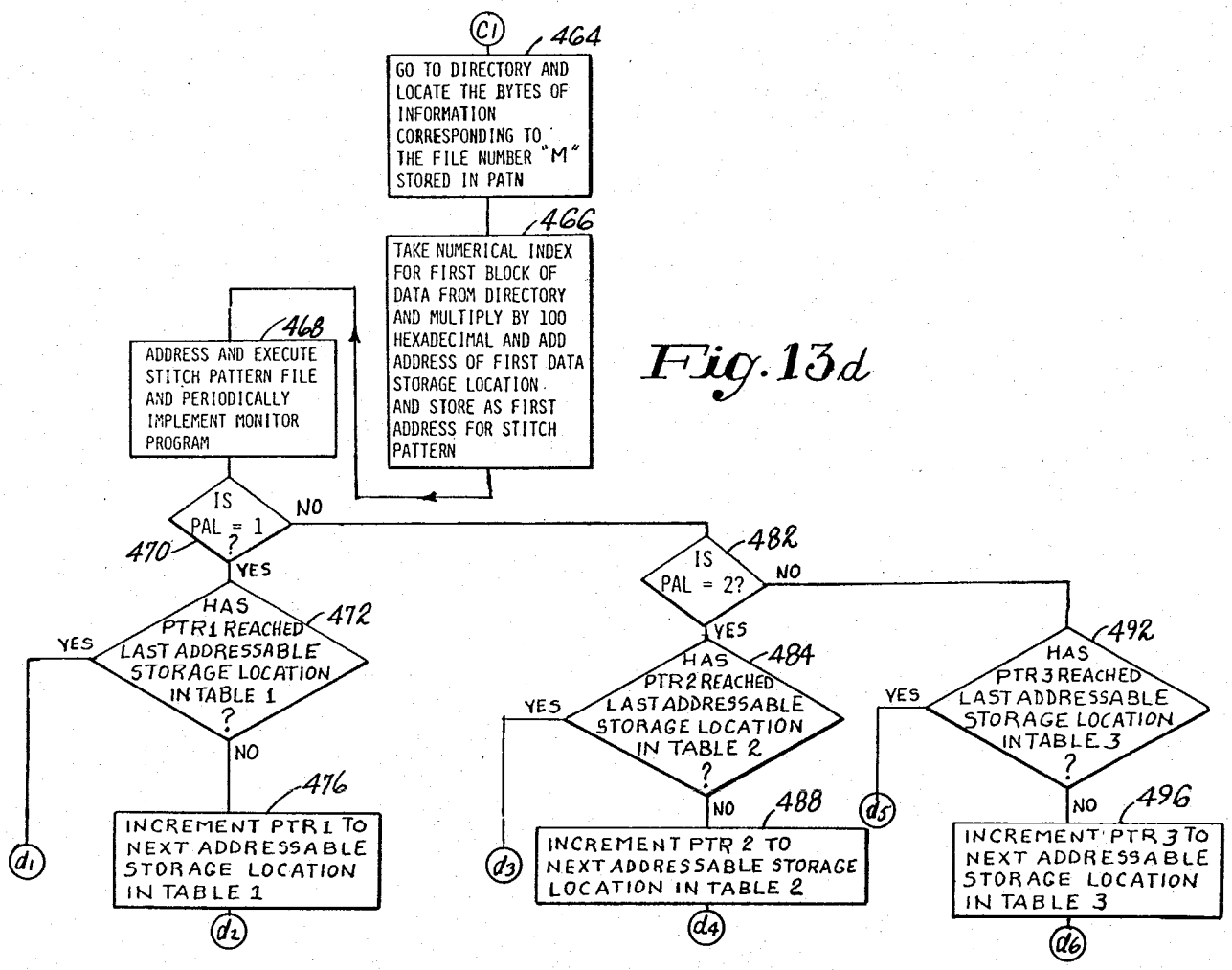
Figure 13E:
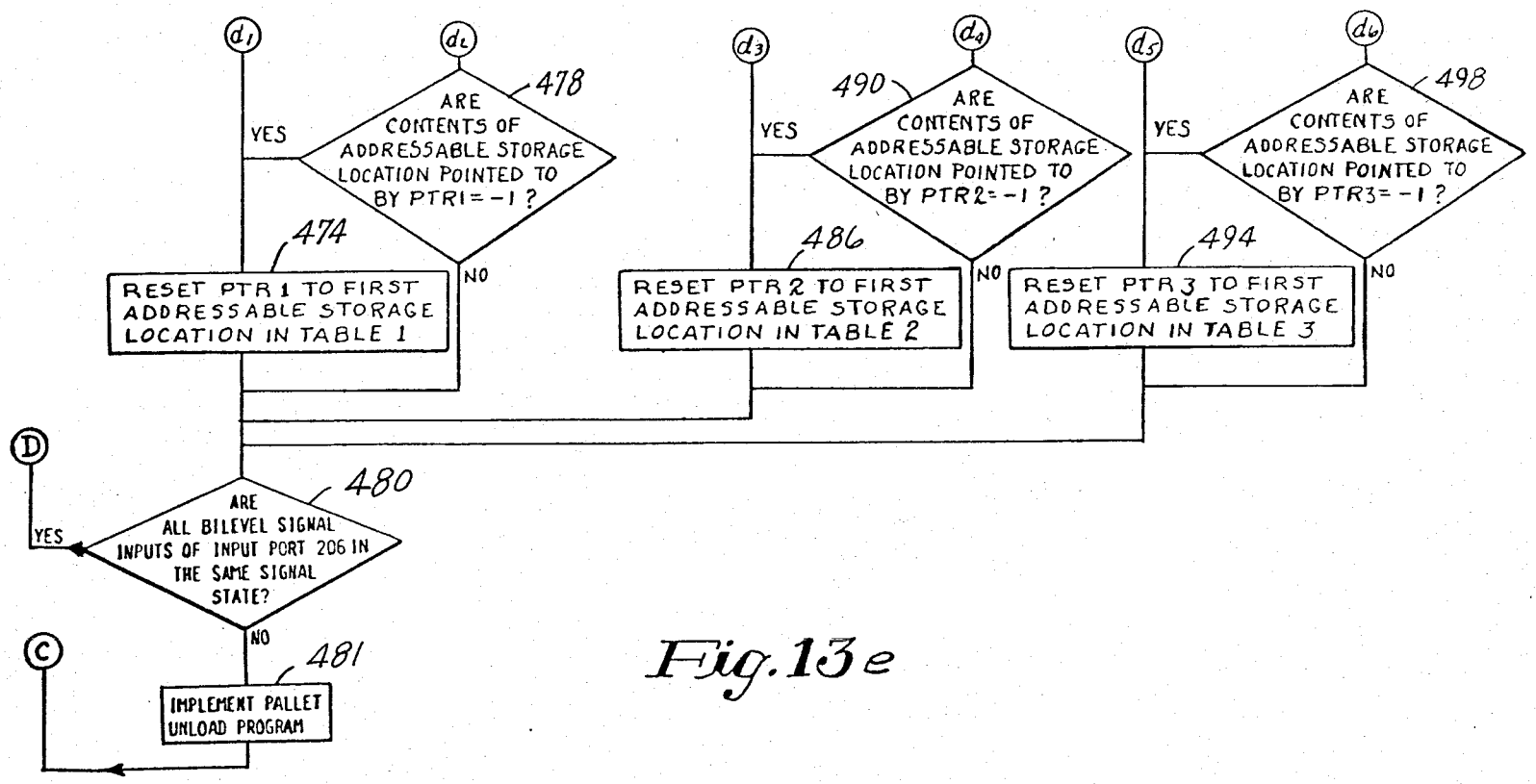

Referring to FIG. 13*b*, if a keyboard entry has been made in step 442, then the central processor 200 proceeds via a YES path out of step 442 to a step 446 in FIG. 13*c*. The central processor reads and saves the keyboard value "N" from the controller 208 in the step 446. It will be remembered that the controller 208 provides an ASCII coded signal to the central processor via the eight bit bus 202. In this regard a particular ASCII code will be provided for each key on the keyboard 210. The eight bits of information constituting the value "N" must be analyzed to determine which key has been depressed on the keyboard 210. This is accomplished by first asking in a step 448 whether the value "N" constitutes the ASCII code for an "ENTER" key. This can be any key on the keyboard 210 which has been previously defined as the ENTER key. If the ENTER key has been depressed then a YES path is pursued to a step 450. Wherein a TABLE ENTRY program is implemented. The TABLE ENTRY program will be explained in detail hereinafter. For now, it is merely to be understood that the TABLE ENTRY program allows the operator of the machine to assign stitch pattern files to TABLE 1, TABLE 2, or TABLE 3.

Referring again to step 448, if the ENTER key has not been depressed, then the central processor proceeds along the NO path to a step 452. Step 452 inquires as to whether the keyboard value "N" denotes a START key. Again this is merely asking whether a particular predefined ASCII coded key (that has been arbitrarily defined as the START key) has been depressed. If the answer is in the negative, then a NO path is pursued back through the common return junction C in FIG. 13*a* to step 410. If on the other hand, the START key has been depressed, then the central processor proceeds to a step 454 wherein the value of the software reference PATN is queried. It will be remembered that the software reference PATN will contain the contents of an addressable storage location pointed to by one of the pointers PTR 1, PTR 2, or PTR 3 as set forth in steps 426, 430 or 432. If the pointed to storage location has not had a previous file number entered therein, then the value of the storage location and hence PATN will be a minus one. In this case, the central processor will pursue a YES path from the step 454 to a step 456 which transmits the message "NO FILE" to the display 212. The central processor will maintain the message for one second before returning back to step 410 via common return junction C in FIG. 13*a*.

Referring again to step 454, if the software reference PATN is other than minus one, then the NO path is pursued to a step 458 wherein the central processor sets the RLATCH equal to zero. This setting of the RLATCH equal to zero allows the central processor 200 to operate in an automatic mode unless otherwise interrupted. The central processor 200 now proceeds to a step 460 after having initially set the RLATCH equal to zero in step 458.

Step 460 merely repeats the question asked in step 410 as to whether all bilevel inputs of input port 206 are in the same signal state. It will be remembered that this step is merely asking whether an operative pallet handling system has been connected to the central processor 200. If an operative pallet system is present, then the bilevel inputs to the input port 206 will not all be in the same signal state as previously discussed relative to step 410. This will result in the central processor 200 pursuing the NO path from step 460 to step 462.

Step 462 calls for an implementation of the PALLET LOAD program which has been previously illustrated and discussed in FIG. 10. It will be remembered that his program sequentially operates the pallet handling mechanism 34 so as to drop a pallet from the input load position to the middle position wherein the pallet is mated to the carriage 24 of the X, Y motion control system. When the last step of the PALLET LOAD program is implemented, the central processor moves to step 464 within FIG. 13*d* of the EXECUTIVE program.

It is to be noted that step 464 is directly pursued out of step 460 in the event that an operative pallet handling system is not determined to be present. Specifically, if all bilevel inputs are in the same signal state, then the YES path is pursued from step 460 to step 464. As will be explained hereinafter, this allows for the automatic sewing of an assigned stitch pattern file without a pallet handling apparatus being present.

Step 464 causes the central processor 200 to consult the directory and locate the bytes of information corresponding to the file number "M" stored in the software reference PATN. It will be remembered that the directory is organized on the basis of an equal number of information bytes for each stitch pattern file. In this manner, the number of bytes for each file is merely multiplied by the number "M" so as to arrive at the first byte of information for the file "M". It will be remembered that the first byte of directory information for each file is the numerical index for the first block of data associated with the file.

The memory address within the main memory of the central processor 200 is calculated from this numerical index in step 466. Specifically, the numerical index for the first block of data is multiplied by 100 hexadecimal (otherwise known as 256 decimal) and the results are added to the first addressable memory location of the portion of main memory allocated to data. In other words, a normal partitioning of the main memory dictates that storage space first be set aside for needs other than data. The address of the next available storage location would constitute the address of the first addressable memory location of that portion of main memory allocated to data. The computer stores the results of the calculation in 466 as the first address for the stitch pattern. The next step 468 is to execute the stitch pattern file which has thus been located within main memory. It is to be noted that the step 468 also calls for the periodic implementation of the MONITOR program. It will be remembered from FIG. 11 that the MONITOR program checks as to the status of any pallet awaiting removal by the operator from the ejector mechanism. Following the end of the stitching pattern, the central processor 200 immediately moves to a step 470 which asks whether the software reference PAL is equal to one. It will be remembered that the software reference PAL contains the numerical value of the pallet code sensed in step 414. This numerical value is stored in the software reference PAL in step 418 and is thereafter utilized in steps 424 to 432 to consult the correct table that is to be associated with the sensed pallet code. The stitch pattern file number obtained from the addressable storage location in the thus consulted table defines the stitch pattern that is sewn immediately upstream of step 470. It is the purpose of step 470 to ascertain whether it was TABLE 1 that was thus consulted in steps 424 to 432. In the event that this was the case, PAL will be equal to one and the YES path will be pursued from step 470 to a step 472 wherein the question is asked whether PTR 1 has reached the last addressable storage location in TABLE 1. It will be remembered from the discussion of step 404 that there are preferably nine addressable storage locations in each table. Step 472 hence asks whether the current value of PTR 1 is equal to the ninth address within the twenty-seven consecutive addresses set aside to define the addressable storage locations in step 404. If PTR 1 is determined to be at the last addressable storage location in TABLE 1, then the YES path is pursued from step 472 to a step 474. Step 474 resets PTR 1 to the address of the first addressable storage location. It will be remembered that this address has been defined in step 404 when TABLE 1 was established.

Referring again to step 472, if PTR 1 has not reached the last addressable storage location in TABLE 1, than the NO path is pursued to a step 476 wherein the pointer PTR 1 is incremented by one so as to contain the address of the next addressable storage location in TABLE 1. The central processor now proceeds to a step 478 and inquires as to whether the contents of the addressable storage location now pointed to are equal to minus one. It will be remembered that all addressable storage locations need not contain file numbers. In the event that only three stitch pattern files are necessary within a table, then the fourth through the ninth storage locations will merely contain minus ones. Step 478 hence merely is asking whether the pointer has gone past the last successive storage location in TABLE 1 to have a file number. In the event that this is the case, the YES path is pursued to step 474 wherein the PTR 1 is again set equal to the address of the first addressable storage location in TABLE 1. In this manner, the PTR 1 is always reset to the first addressable storage location of TABLE 1 after all assigned stitch pattern file numbers in the table have been utilized.

Referring again to step 478, if the contents of the addressable storage location now pointed to by PTR 1 are not minus one, then the address contained within PTR 1 is not disturbed. The central processor proceeds out of step 478 along a NO path to a common junction downstream of step 474. At this point, the address in the software reference PTR 1 is either pointing to the first addressable storage location in TABLE 1 by virtue of step 474 or to the next addressable storage location to contain a stitch pattern file number as has been determined in step 478. The EXECUTIVE program is now ready to proceed to a step 480 based on the fact that the pointer for TABLE 1 is correctly pointing to the appropriate storage location. It will, however, be remembered that the above is premised on the software reference PAL being equal to one in step 470 so as to require the changing of the software reference PTR 1.

Referring to step 470, it is seen that if the software reference PAL is not equal to one, then a NO path is pursued to a step 482. Step 482 determines whether the pallet code sensed in step 414 and thereafter stored in PAL is either two or three. In the event that the pallet code is two, then a YES path is pursued to step 484. Step 484 as well as steps 486, 488 and 490 analyze the pointed PTR 2 in much the same manner as has been previously discussed for PTR 1. In other words, PTR 2 is either the reset back to the address of the first addressable storage location of TABLE 2 in step 486 or is incremented by one in step 488 so as to point to an addressable storage location containing a file number as verified in step 490.

Referring again to step 482, if the pallet code in the software reference PAL is three, then the NO path is pursued to a series of steps 492 through 498. In this regard, the software reference PTR 3 is either reset back to the address of the first addressable storage location of TABLE 3 in the step 494 or is incremented by one in step 496 so as to point to an addressable storage location in TABLE 3 containing a file number as verified in step 498.

It is to be noted that following the correct setting of either PTR 2 or PTR 3, the central processor proceeds to the step 480 in much the same manner as has been previously discussed for PTR 1. In this manner, either PTR 1, PTR 2 or PTR3 has been appropriately set upstream of step 480. The particular pointer having been determined by the pallet code present within the software reference PAL.

Referring now to step 480, it is seen that the central processor is now inquiring as to whether all bilevel signal inputs of input port 206 are in the same signal state. This again is asking the same question as has been previously asked in steps 404 and 460, namely, is an operative pallet handling apparatus present. In the event that a pallet handling apparatus is not present, the YES path is pursued through common junction "D" to step 412 in FIG. 13*a*. Referring to step 412, it is seen that the central processor 200 sets the RLATCH equal to one to assure a non-automatic mode of operation when executing the EXECUTIVE program without a pallet handling apparatus.

Referring again to step 480, it is seen that the NO path is pursued in the event that all bilevel signal inputs are not in the same signal state. This path will be taken if an operative pallet handling apparatus is present. The central processor 200 proceeds along the NO path to the PALLET UNLOAD program of step 481. This program is illustrated in FIGS. 12*a* and 12*b*. It will be remembered that the execution of the stitch pattern file brings the pallet back to the position within the pallet handling mechanism 34 so as to allow for subsequent unloading. The unloading occurs in the manner dictated by the program steps outlined in FIGS. 12*a* and 12*b*. At the end of the PALLET UNLOAD program the central processor 200 again returns through common junction "C" to step 410 in FIG. 13*a*. At this point, the operator will most likely have loaded another pallet which can be sensed by the pallet identification sensor 50. This will result in the NO path being pursued out of the step 416 in FIG. 13*a*. The central processor 200 continues in the automatic mode through step 418 wherein the sensed pallet code is converted to a numerical value and stored in the software reference PAL. The central processor next associates the numerical value of the sensed pallet code stored in PAL with the appropriate table of file numbers in steps 424 through 432. The contents of the addressable storage location of the appropriate table are stored in the software reference PATN. The stitch pattern file number which is thus stored in PATN is displayed in step 436. If this stitch pattern file number is not changed by the operator depressing a key on the keyboard, then the central processor will pursue the NO path out of step 442 to the step 444. Since the automatic mode has not been interrupted, the RLATCH remains equal to zero, and the YES path is pursued to step 460. The central processor notes that an automatic pallet handling system is present so as to require execution of the PALLET LOAD program in step 462. The stitch pattern file, denoted by the file number "M", is accessed from main memory and thereafter executed in step 468. The central processor now proceeds to set the pointer of the table that was used to obtain the file number of the stitch pattern that has just been executed. This is done in steps 470 through 478 and 482 through 498 by noting the value of the software reference PAL and accordingly setting the pointer of the table associated therewith. The central processor proceeds to step 480 and again notes that automatic pallet handling is present so as to require execution of the PALLET UNLOAD program in step 481. The completed pallet is thereafter unloaded and the central processor 200 returns through common junction "C" to the beginning of the EXECUTIVE program. This automatic processing of pallets will continue until such time as either a pallet is not timely loaded by the operator so as to be sensed following the completion of the stitching of the previous pallet or until such time as a pallet is not appropriately removed at the "EJECT"

position. In this latter instance, the PALLET UNLOAD program of FIGS. 12*a* and 12*b* will interrupt the automatic sequence and request a "START" authorization from the operator.

It is also to be noted that the machine can be operated without a pallet handling apparatus. Referring to step 410, it is seen that the YES path is pursued in the event that an operative pallet handling apparatus is not initially found by the central processor 200. The RLATCH is set equal to one in step 412 and the central processor next inquires in step 424 as to whether the software reference PAL equals one. It will be remembered that the initial status of the software reference PAL is set equal to one in step 402. The status of the software reference PAL will result in the YES path being pursued from step 422 to step 426. The central processor 200 now stores the contents of the addressable storage location of TABLE 1 pointed to by PTR 1 in the software reference PATN. The file number appearing in the thus read storage location will be displayed in step 436 and the central processor will cycle through step 442 until a keyboard entry has been detected. If the START key is depressed, the central processor will proceed through step 452 to step 460 and inquire as to whether a pallet handling apparatus is present. Since there isn't, the YES path is pursued from step 460 to step 464 which in conjunction with step 466 locates the identified stitch pattern file in memory. The stitch pattern file is thereafter accessed and executed in step 468. Following completion of the stitch pattern, the central processor sets the software reference PTR 1 to the next appropriate storage location in TABLE 1. The central processor now notes that an operative pallet handling apparatus is not present in step 480. This results in the YES path being pursued through common junction "D" back to step 412 which again sets the RLATCH equal to one. This will again dictate a non-automatic mode of operation. If the operator has manually or otherwise clamped another pallet into place, then the stitch pattern file currently pointed to in TABLE 1 by PTR 1 will be executed following depression of the START key by the operator. It is of course to be noted that the operator can change this stitch pattern file prior to depressing the START key. In this regard, the stitch pattern file number is always displayed in step 436 allowing the operator the option of depressing the "ENTER" key. This will be detected in step 448 and the central processor will proceed to the step 450 wherein the TABLE ENTRY PROGRAM is entered.

Figure 14B:
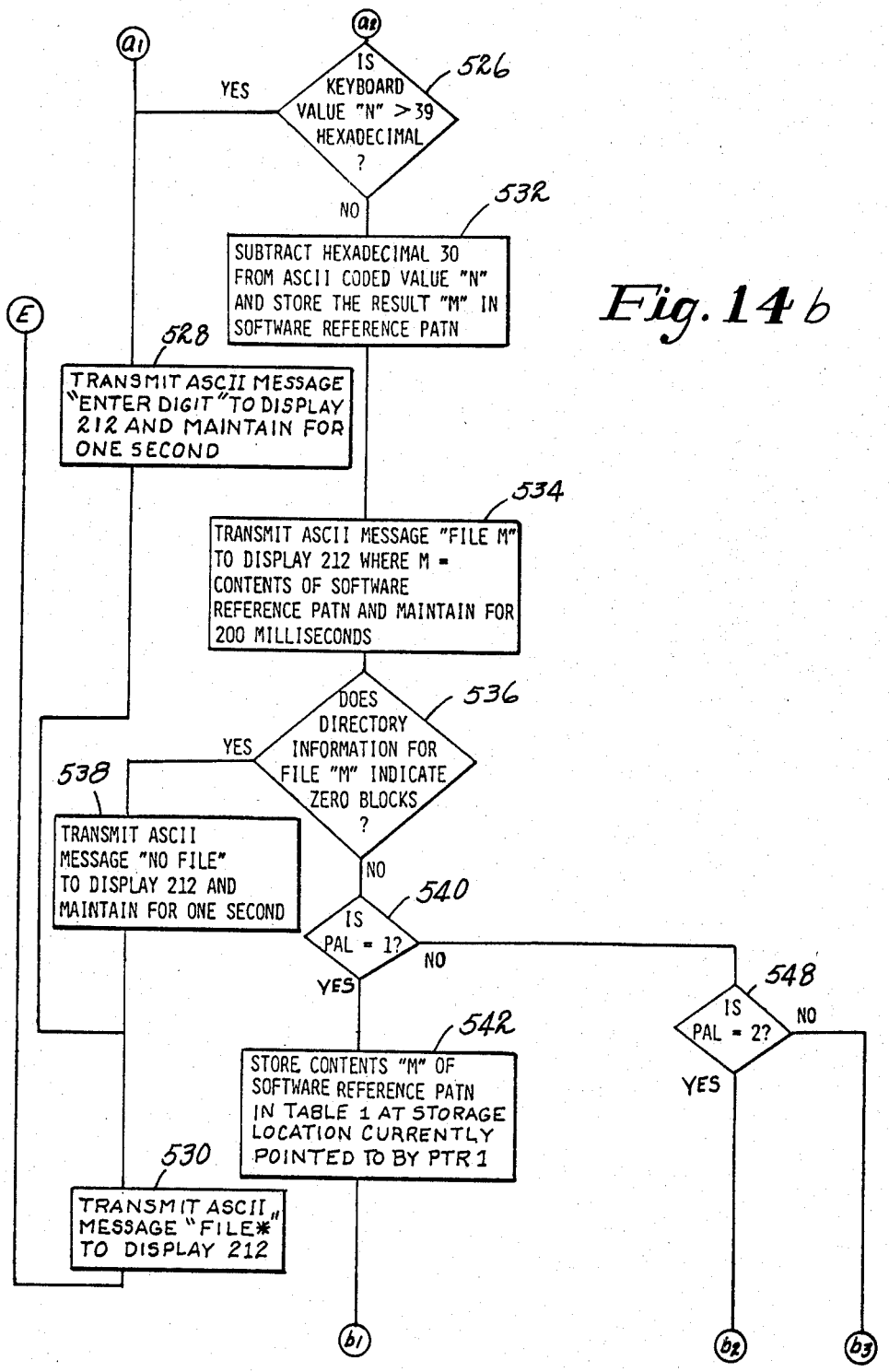

Before discussing the TABLE ENTRY PROGRAM in detail, it is to be merely noted that this table can also be entered during the automatic mode. In this regard, the operator merely need depress the ENTER key any time prior to step 442. The EXECUTIVE program will immediately proceed to step 450. It is still furthermore to be noted that the EXECUTIVE program will require entry into the TABLE ENTRY program in the event that a stitch pattern file number has not been assigned to a particular pallet code sensed in step 414. It will be remembered that all addressable storage locations in each table are initially set equal to minus one in step 406. Any pallet code that is sensed for the first time in step 414 will be associated with a table in step 426, 430 or 432 that has all addressable storage locations equal to minus one. This will mean that the software reference PATN will be minus one in step 434. This will result in a switch to a non-automatic mode in step 438 if the EXECUTIVE program has previously been in an automatic mode. On the other hand, the EXECUTIVE may already have been in a non-automatic mode in which case the setting of the RLATCH equal to one in step 438 is redundant. In either event, the central processor will proceed to step 448 and transmit the ASCII message "FILE*" to display 212. This is a message to the operator essentially asking that a file assignment be made to the pallet which has been presented. The central processor will continue to cycle through the step 442 waiting for the ENTER key to be depressed. When this occurs, the central processor will proceed along the YES path from step 448 to step 450 which implements the TABLE ENTRY PROGRAM of FIGS. 14*a*–14*c*.

Referring to FIG. 14*a*, the TABLE ENTRY PROGRAM is seen to begin with a step 500 which asks whether the software reference PAL is equal to one. It will be remembered that the software reference PAL is equal to one if a pallet handling system is not in place. The software reference PAL might otherwise be equal to one if a pallet code having a numerical value of one has been sensed in step 414. In either event, the central processor noting a PAL equal to one condition will pursue a YES path out of step 500 to a step 502. Step 502 sets all addressable storage locations of TABLE 1 equal to minus one. This essentially wipes out any file numbers that have been previously stored in TABLE 1. Step 502 is, of course, redundant if no file numbers have been previously stored. In either event, the central processor proceeds to a step 504 and sets the software reference PTR 1 equal to the address of the first addressable storage location in TABLE 1. This address has been previously established in step 404 of the EXECUTIVE program and is hence available for use in step 504. TABLE 1 is now ready to receive new stitch pattern file numbers beginning at its first addressable storage location.

Referring again to step 500, it is to be noted that if the software reference PAL is not equal to one, then a NO path is pursued to a step 506. Step 506 determines whether the sensed pallet code of step 414 that is stored in PAL is either a two or a three. In the event that the pallet code is two, the central processor will proceed to set all addressable storage locations in TABLE 2 equal to minus one in a step 508. The software reference PTR 2 will thereafter be set equal to the address of the first addressable storage location of TABLE 2 in a step 510. Referring again to step 506, if the pallet code is three, the central processor will proceed to set all addressable storage locations of TABLE 3 equal to minus one in a step 512. The software reference PTR 3 will thereafter be set equal to the address of the first addressable storage location of TABLE 3 in a step 514.

It is to be noted that following the setting of a pointer in either TABLE 1, TABLE 2 or TABLE 3, the central processor proceeds to a step 516 in the TABLE ENTRY PROGRAM. The RLATCH is set equal to one in step 516 so as to assure a non-automatic mode of operation. The central processor now awaits a keyboard entry from the operator in a step 518. The central processor proceeds to a step 520 when a keyboard entry has been made and both reads and stores the keyboard value "N" from the controller 208. As has been previously discussed, the keyboard values from the controller 208 will be in ASCII code. The central processor now proceeds to step 522 and asks whether the keyboard value "N" corresponds to the ASCII code for the EXIT key. It is to be appreciated that the EXIT key can be any arbitrarily designated key on the keyboard 210 which is not otherwise being used. This designated key will have an ASCII code that is to be used as the basis of comparison in step 522. Assuming that depression of the EXIT key has not been detected in step 522, the central processor proceeds to a series of steps 524 (appearing in FIG. 14*a*) and 526 (appearing in FIG. 14*b*). Step 524 asks whether the keyboard value is less than 31 hexadecimal whereas step 526 asks whether the keyboard value is greater than 39 hexadecimal. This hexadecimal range defines the numerical keys one to nine on the keyboard 210. It is to be understood that depression of any other key on the keyboard 210 (other than the EXIT key which is covered by step 422) will result in either of the YES paths being taken out of steps 524 or 526 to a step 528 in FIG. 14*b*. Step 528 transmits the message "ENTER DIGIT" to the display 212. This essentially advises the operator to depress only numerical keys on the keyboard 210. the "ENTER DIGIT" message is followed by a further message generated in step 530. This further message is a "FILE*" which asks the operator to again attempt to make a file assignment. The central processor now returns to step 518 via common return junction "E". Step 518 awaits the next keyboard entry. When a numerical key from one to nine has been depressed, the central processor will proceed through steps 524 and 526 to a step 532. At this point, the central processor will subtract hexadecimal 30 from the keyboard value "N" and store the result "M" in the software reference PATN. The next step 534 is to transmit the message "FILE M" to the display 212 wherein "M" represents the contents of the software reference PATN. The central processor now proceeds in a step 536 to consult the directory and inquire as to whether there are any blocks of data noted for file "M". In this regard, it will be remembered that the directory contains a byte of information relative to each file which indicates the number of data blocks for the file. If this byte indicates zero data blocks, then there is in fact no stitch pattern file resident within the memory under this file number. In this case, the YES path is pursued from step 536 to a step 538. Step 538 transmits an ASCII message of "NO FILE" to the display 212. This message is displayed for at least one second so as to assure that the operator receives the message. The central processor thereafter transmits the message "FILE*" in step 530 and proceeds to common return junction "E" upstream of step 518. Step 518 now awaits the next keyboard entry. The operator is moreover aware that the previous keyboard entry did not identify a valid file within the machine. Specifically the message "NO FILE" of step 538 has told the operator that no such stitch pattern file exists.

Assuming that the next keyboard entry is a numerical key identifying a file having a certain number of blocks of data, the central processor will proceed through the step 536 along a NO path to a step 540. Step 540 now asks whether the software reference PAL is equal to one. The software reference PAL will be equal to one if either a pallet code of one has been sensed or if a manual mode of operation is in effect through step 412. In either event, the central processor will proceed to a step 542 wherein the contents "M" of the software reference PATN are stored in the storage location of TABLE 1 currently pointed to by PTR 1. This will be the first addressable storage location in TABLE 1 by virtue of step 504 if this is the first successful keyboard entry passing through step 536 to step 540. The central processor proceeds to step 544 and inquires as to whether the software reference PTR 1 contains the address of the last addressable storage location in TABLE 1. This address is known by virtue of step 404 wherein TABLE 1 was established. If PTR 1 does not contain the address of the last addressable storage location (so as to be pointing thereto), the central processor will proceed to a step 546. Step 546 increments the address of PTR 1 so as to point to the next addressable storage location in TABLE 1. The central processor now returns via common junction "E" to step 518 and awaits the next keyboard entry. It is also to be noted that the central processor will directly return to step 518 from step 544 in the event that PTR 1 is at the last addressable storage location.

Referring again to step 540, in the event that the software reference PAL does not equal one, the central processor will proceed along a NO path to a step 548. Step 548 asks whether the software reference PAL is equal to two. This will be the case if a pallet code of two has been sensed in step 414. In the event that PAL is equal to two, the central processor will proceed to step 550 and store the contents "M" of the software reference PATN in the storage location currently pointed to by PTR 2. The central processor will then proceed through steps 552 and 554 and increment the software reference PTR 2 if the same is not already pointing to the last addressable storage location of TABLE 2. Having this updated the status of PTR 2, the central processor will proceed via common return junction "E" to step 518 and await the next keyboard entry.

Referring again to step 548, in the event that the software reference PAL does not equal two, the central processor will proceed to a step 556 on the basis that the pallet code stored in PAL has a numerical value of three. The central processor will store the contents "M" of the software reference PATN in the addressable storage location of TABLE 3 currently pointed to by PTR 3. The central processor will thereafter proceed through steps 558 and 560 and update the status of PTR 3. The central processor will thereafter proceed via common return junction "E" to step 518 and await the next keyboard entry.

It is to be appreciated that the operator can enter up to nine stitch pattern file numbers in any of the tables by virtue of respectively cycling through the TABLE ENTRY program. In this regard each file number that has been approved by the program will be stored in the appropriate table of file numbers. It is moreover to be understood that the operator may choose to enter only one stitch pattern file number into a particular table. In this latter instance, all addressable storage locations of the table other than the first will contain minus ones.

When the operator has entered the last file number to be assigned to a particular table, the EXIT key is depressed on the keyboard 210. This is detected in step 522 of the TABLE ENTRY program. Referring to step 522, the keyboard value "N" is checked to see whether it corresponds to the ASCII code for the EXIT key. In the event that this is the case, the central processor will proceed to a step 562 and inquire as to whether the software reference PAL is equal to one. If the answer is YES, the central processor proceeds in a step 564 to reset the software reference PTR 1 to the address of the first addressable storage location of TABLE 1. This allows the central processor to exit from the TABLE ENTRY program with an appropriate table of file numbers defined in TABLE 1 and the pointer for this table pointing to the first addressable storage location within the thus established table. The central processor exits in a step 566 of the TABLE ENTRY program to a step 444 within the EXECUTIVE program. Since the RLATCH is equal to one, the EXECUTIVE program will await the depression of the start key. The central processor will thereafter sew one of the stitch patterns assigned to the particular pallet code through the TABLE ENTRY program each time that code is sensed. The stitch pattern sewn will depend on which storage location is currently being pointed to within the table of file numbers established in the TABLE ENTRY program.

Referring again to step 562, it is to be noted that if the software reference PAL is other than one, the central processor proceeds to a step 568. Step 568 asks whether the pallet code stored in the software reference PAL is equal to two. In the event that the answer is YES, the software reference PTR 2 is set equal to the address of the first addressable storage location in TABLE 2. This is done in a step 570. If the answer is NO in step 568, the central processor proceeds to a step 572 and assumes that the pallet code resident in the software reference PAL is three. The central processor hence resets the software reference PTR 3 to the address of the first addressable storage location of TABLE 3 in a step 572.

It is to be noted that the central processor proceeds to exit from the TABLE ENTRY program via step 566 after either step 570 or step 572. In this regard the appropriate table of file numbers has been established and the pointer for this table is pointing to the first addressable storage location of that table.

It is to be appreciated that the TABLE ENTRY program can be utilized to establish tables of file numbers for three distinct pallet codes. Each of these codes when sensed within the EXECUTIVE program, will result in a stitch pattern being sewn. The particular stitch pattern there sewn will depend on where a pointer is pointing within a table of file numbers particularly established for the particularly sensed pallet code. These stitch patterns will be successively sewn in the manner detected by the table.

From the foregoing, it is to be understood that a preferred embodiment has been disclosed of a system for processing workpieces prearranged within pallets wherein a number of separate stitch patterns may need to be sewn on one or more of these workpieces. It is to be appreciated that alternative logic elements to those disclosed in this preferred embodiment may be used without departing from the scope of the invention.

What is claimed is:

1. A system for automatically processing a plurality of workpieces wherein each workpiece is to have one or more predefined stitch patterns sewn thereon, said system comprising:

means for automatically identifying each workpiece that is presented to the system;

means for accessing, in a predetermined sequence, the stitch patterns that are to be sewn on the automatically identified workpiece whereby one of the stitch. patterns is accessed each time the workpiece is presented to the system; and means for automatically sewing the particularly accessed stitch pattern on the workpiece.

2. The system of claim 1 wherein said means for accessing the stitch patterns that are to be sewn comprises:

means for storing a sequence of identifications of stitch patterns that are to be sewn on particularly identified workpieces; and means for utilizing the sequentially stored identifications of stitch patterns when accessing the stitch patterns that are to be sewn on the particularly identified workpieces.

3. The system of claim 1 wherein each workpiece having a predetermined sequence of stitching patterns that are to be sewn thereon is prearranged within a workpiece holder having a particular code whereby said means for automatically identifying each workpiece presented to the system comprises:

means for sensing the code present on a workpiece holder containing the workpiece.

4. The system of claim 2 wherein said means for accessing the stitch patterns that are to be sewn comprises:

means for storing sequences of stitch pattern identifications which identify stitch patterns that are to be sewn in association with particular sensed codes; and means for utilizing the particular sequence of stored identifications of stitch patterns associated with a particular code when accessing a stitch pattern to be sewn on a workpiece prearranged within a workpiece holder having the particular code.

5. The system of claim 4 wherein said means for accessing the stitch patterns that are to be sewn comprises:

means for incrementally pointing to the identification of the next stitch pattern to be sewn in a particular sequence, whereby the identification of the next stitch pattern can be utilized in accessing the stitch pattern to be sewn the next time the particular code is sensed.

6. The system of claim 6 wherein said system comprises:

means for verifying that at least one stitch pattern identification has been previously stored in association with a sensed code; and means for requesting a stitch pattern file assignment in the event that no stitch pattern identifications have been previously associated with the sensed code.

7. A system for automatically processing a plurality of workpieces wherein each workpiece is to have one or more predefined stitch patterns sewn thereon, said system comprising:

means for automatically identifying each workpiece that is presented to the system;

means for accessing a first stitch pattern previously assigned to the workpiece in response to the automatic identification of the workpiece; and means responsive to the accessing of the first stitch pattern for changing to a second stitch pattern previously assigned to the workpiece so as to thereby define a different stitch pattern to be accessed the next time the workpiece is presented to the system.

8. The system of claim 7 wherein each workpiece having a predetermined sequence of predefined stitch patterns to be sewn thereon is prearranged within a workpiece holder having a particular code and said means for automatically identifying each workpiece comprises:

means for sensing the code of the workpiece holder containing the workpiece.

9. The system of claim 8 further comprising:

means for maintaining a sequence of identifications of stitch patterns that are to be sewn each time a particular code is sensed whereby an identification of the first stitch pattern is utilized by said means for accessing the first stitch pattern previously assigned to the workpiece.

10. The system of claim 9 wherein said means for changing to a second stitch pattern previously assigned to the workpiece comprises:

means for pointing to the next stitch pattern identification within the predetermined sequence of identifications associated with the code of the particular workpiece holder containing the workpiece.

* * * * *